US008628287B2

(12) United States Patent
Vehmeijer et al.

(10) Patent No.: US 8,628,287 B2
(45) Date of Patent: Jan. 14, 2014

(54) FALLPIPE STONE DUMPING VESSEL

(75) Inventors: Terence Willem August Vehmeijer, The Hague (NL); Joop Roodenburg, Delft (NL); Marc Louis Brinkman, Delft (NL)

(73) Assignee: ITREC B.V., Schiedam (NL)

( * ) Notice: Subject to any disclaimer, the term of this patent is extended or adjusted under 35 U.S.C. 154(b) by 606 days.

(21) Appl. No.: 12/672,195

(22) PCT Filed: Aug. 6, 2008

(86) PCT No.: PCT/NL2008/000188

§ 371 (c)(1),
(2), (4) Date: Apr. 6, 2010

(87) PCT Pub. No.: WO2009/020385

PCT Pub. Date: Feb. 12, 2009

(65) Prior Publication Data

US 2011/0206484 A1 Aug. 25, 2011

(30) Foreign Application Priority Data

Aug. 6, 2007 (NL) ..... 2007/000193

(51) Int. Cl.

| | |
|---|---|
| ***E21B 19/00*** | (2006.01) |
| ***E21B 19/14*** | (2006.01) |
| ***E21B 15/00*** | (2006.01) |
| ***E21B 15/02*** | (2006.01) |
| ***F16L 1/20*** | (2006.01) |
| ***F16L 1/12*** | (2006.01) |

(52) U.S. Cl.
USPC ..... 414/22.64; 166/355; 405/158; 405/170

(58) Field of Classification Search
USPC ..... 114/264; 166/355; 405/158, 166, 170; 414/137.4, 22.51–22.56, 22.64, 22.69, 414/22.71, 745.4, 745.8
See application file for complete search history.

(56) References Cited

U.S. PATENT DOCUMENTS

RE26,284 E * 10/1967 O'Neill et al. ..... 175/57
3,390,654 A * 7/1968 Bromell et al. ..... 114/264

(Continued)

FOREIGN PATENT DOCUMENTS

| | | | |
|---|---|---|---|
| CN | 1635260 | A | 7/2005 |
| GB | 1 440 676 | A | 6/1976 |
| WO | WO-00/05525 | A2 | 2/2000 |

*Primary Examiner* — Gregory Adams
(74) *Attorney, Agent, or Firm* — Birch, Stewart, Kolasch & Birch, LLP

(57) ABSTRACT

A tailpipe stone dumping vessel (1) for stone dumping through a fallpipe suspended from the vessel, comprising: • a hull (1*a*), • a fallpipe section storage for storing fallpipe sections (2), • a tower (20) at least comprising fallpipe support means (40) for supporting the suspended fallpipe, said tower (20) being adapted for assembly and disassembly of the fallpipe by addition of a fallpipe section to the upper end of the suspended fallpipe or removal of a fallpipe section from the suspended fallpipe, respectively, • a tower gimbal structure (22) provided between the hull and the tower providing a pivotal mode for the tower (20) wherein the tower is pivotable about at least one pivot axis with respect to the hull so that the tower—and the fallpipe suspended there from—has in a plane associated with said at least one pivot axis an orientation essentially independent from sea-state induced vessel motions, • hoist means (31, 32, 33, 34) for lowering and raising the suspended fallpipe, • fallpipe section handling means (10-14, 31-34) adapted to—while the tower (20) is in its pivotal mode—advance a fall pipe section to the tower and to bring said fallpipe section in alignment with the uppermost end of the suspended fallpipe in order to assemble the fallpipe and adapted to—while the tower is in its pivotal mode—disconnect a fallpipe section from the uppermost end of the suspended fallpipe and advance it to the storage in order to disassemble the fallpipe.

32 Claims, 21 Drawing Sheets

(56) References Cited

U.S. PATENT DOCUMENTS

Figure 1A:
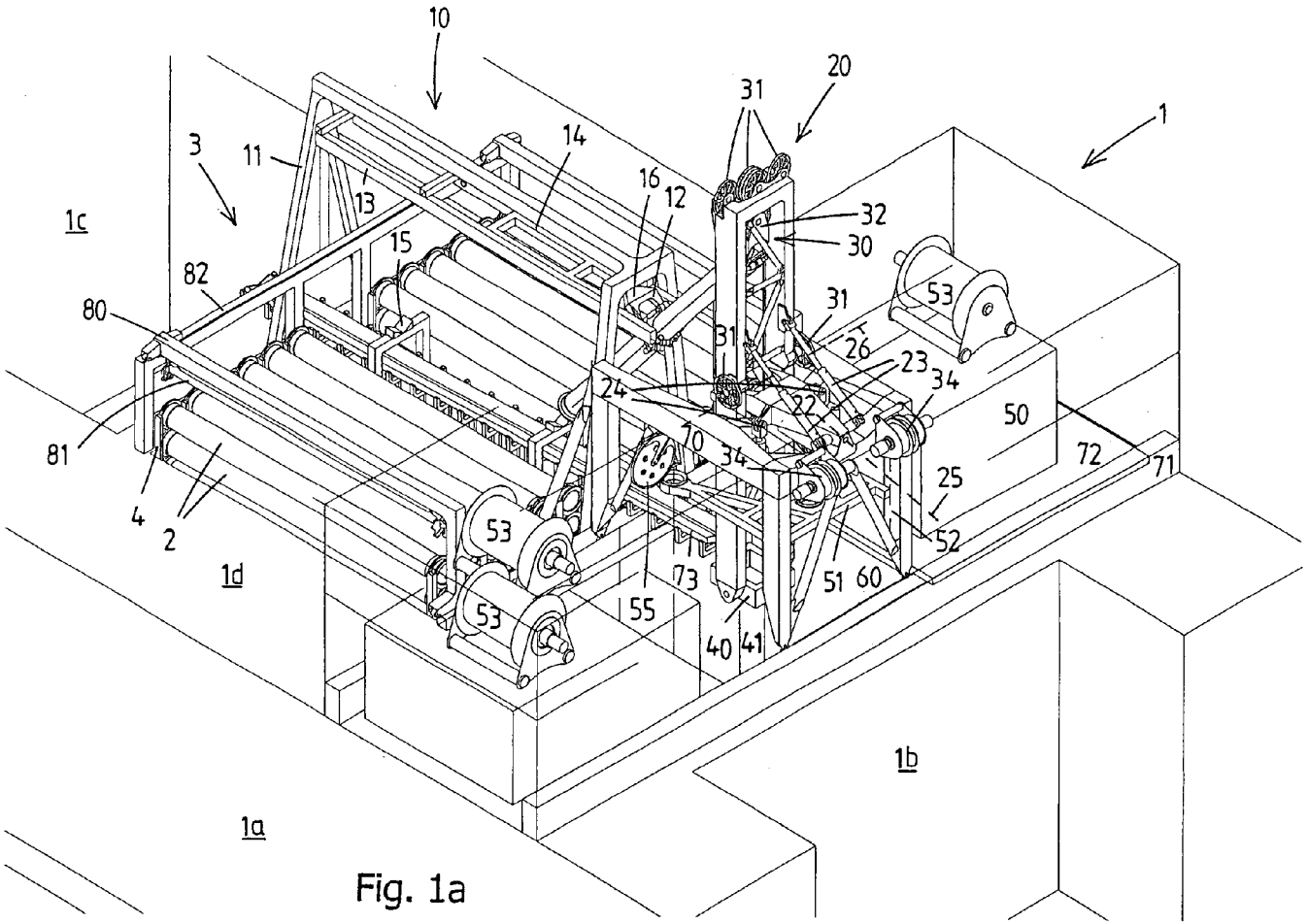

| | | | | | |
|---|---|---|---|---|---|
| 3,419,090 | A | | 12/1968 | Van Dorn | |
| 3,520,358 | A | * | 7/1970 | Brooks et al. | 166/356 |
| 3,581,506 | A | * | 6/1971 | Howard | 405/166 |
| 3,918,379 | A | * | 11/1975 | McNary et al. | 114/264 |
| 4,230,421 | A | * | 10/1980 | Springett et al. | 405/168.3 |
| 4,486,123 | A | * | 12/1984 | Koch et al. | 405/169 |
| 4,662,785 | A | * | 5/1987 | Gibb et al. | 405/195.1 |
| 5,330,294 | A | * | 7/1994 | Guesnon | 405/224.2 |
| 5,421,675 | A | * | 6/1995 | Brown et al. | 405/170 |
| 5,464,307 | A | * | 11/1995 | Wilkins | 405/166 |
| 6,352,388 | B1 | * | 3/2002 | Seguin | 405/166 |
| 6,361,250 | B1 | * | 3/2002 | de Varax | 405/158 |
| 6,425,709 | B1 | * | 7/2002 | Frijns | 405/170 |
| 6,742,596 | B2 | | 6/2004 | Haugen | |
| 2002/0096337 | A1 | | 7/2002 | Bouligny et al. | |
| 2002/0159839 | A1 | * | 10/2002 | Frijns et al. | 405/166 |
| 2007/0158079 | A1 | | 7/2007 | Webre et al. | |

* cited by examiner

FALLPIPE STONE DUMPING VESSEL

A first aspect of the present invention relates to a fallpipe stone dumping vessel for stone dumping through a fallpipe suspended from the vessel.

Stone dumping vessels are employed to dump and often also transport stones of various sizes and other suitable aggregate material for offshore and coastal protection applications, including the stabilization, protection and covering of cables, pipes and flowlines, freespan correction, upheaval buckling prevention and filling up holes around platforms, structures and rigs. Other applications include seabed preparation prior to pipe laying, construction of underwater berms, thermal insulation of oil lines, protection against anchors and fishing operations and ballasting of platforms, structures and loading buoys.

In general the stone dumping can be done from a vessel with a large crane, but also through the concepts of side stone dumping vessels and fallpipe vessels. Side stone dumping vessels sail to their destination, where shovels put the stones overboard at a steady pace. This stone dumping method is typically used in shallow water.

Fallpipe vessels are primarily used in deeper water, usually bringing a large amount of stones in their holds. Commonly a Remotely Operated Vehicle (ROV) is arranged at the lower end of the fallpipe to control the accurate dumping of the stones. Typical fallpipe vessels have a loading capacity of 9,000-25,500 tons and a dumping capacity of 700 up to 2000 t/h. A typical fallpipe is composed of pipe sections of 5-8 m having a diameter of 500-1200 mm. Known fallpipe vessels are the Rollingstone, Seahorse, Sandpiper, Nordnes and Tertnes.

A disadvantage of known fallpipe vessels is that assembly and disassembly of the suspended fallpipe is limited or impaired by sea-state induced vessel motions, in particular roll and pitch of the vessel. This means that in "high" seas assembly/disassembly of the fallpipe has to be interrupted, thereby reducing the weather window for these vessels. Also, these vessel motions are likely to cause undesired stresses in the suspended fallpipe.

The aim of the first aspect of the invention is to provide an improved fallpipe stone dumping vessel.

This aim is achieved by providing a fallpipe stone dumping vessel according to a disclosed embodiment.

In a preferred embodiment, the tower gimbal structure is a two-axis gimbal structure allowing the tower in the pivotal mode to be pivotable so that the orientation of the tower and the fallpipe suspended from said tower is essentially independent from sea-state induced vessel motions, in particular roll and pitch. This allows the tower to maintain an orientation aligned with the suspended fallpipe during (dis)assembly of the fallpipe which facilitates the process of lining up of a new fallpipe section with the upper end of the suspended fallpipe. In particular this is advantageous when the fallpipe sections are direct mechanically connected to one another at their ends to obtain a self-supporting fallpipe. Obviously similar advantages relate to the disassembly of the fallpipe.

The pivotal motion of the tower with respect to the hull of the vessel can be a free-pivotal mode, wherein the pivotal motion is caused entirely by forces exerted on the tower by the suspended fallpipe, possibly with some contribution of the tower itself if the centre of gravity thereof is located suitably low. For such a design one can envisage the presence of one or more dampers, e.g. suitable hydraulic cylinders, to dampen the pivotal motions.

In a possible embodiment an active pivoting system is provided on the vessel, e.g. including one or more hydraulic cylinders engaging on the tower, which system causes the desired pivotal motions of the tower (e.g. based on one or more inclination sensors or other suitable electronic sensors).

Also it can be envisaged that a pivotal motion assist system is provided which is designed or operated to assist the pivotal motions of the tower, said motions being instigated by the fallpipe suspended from the tower.

In a preferred embodiment, the centre of gravity of the tower itself lies below the one or more pivot axes of the tower, reducing the forces necessary to align the tower with the fallpipe whether those forces are caused by the fallpipe and/or a active pivoting system or otherwise.

Preferably the fallpipe section handling means comprise a head clamp adapted for clamping an end of fallpipe section, which head clamp is translatable up and down with respect to the tower in order to raise and lower the end of the fallpipe section.

Preferably the fallpipe section handling means are adapted to present the end of a fallpipe section—which has been retrieved from the storage—to the head clamp whilst the head clamp is held at an engagement position thereof, said engagement position being located on or in close vicinity of at least one pivot axis formed by the tower gimbal structure, preferably on the intersection of the two intersecting pivot axes of the tower gimbal structure.

Preferably the head clamp has a main body adapted to be translated up and down along the tower and an articulated engagement part adapted to be brought into engagement with the end of the fallpipe section, wherein orientation means are provided to bring the engagement part in alignment with the end of the fallpipe section presented by the transfer means. The orientation means could include an actuator assembly arranged between the main body part and the articulated part, e.g. one or more hydraulic actuators, or e.g. an actuator assembly mounted on the tower or the gimbal structure at the engagement position, which actuator assembly then cooperates with the articulated part to bring it in its desired position.

Preferably the fallpipe section handling means are adapted to retain and guide the fallpipe section as the head clamp moves upward and raises the upper end of the fallpipe section, the fallpipe section handling means guiding the lower portion of the fallpipe section until the fallpipe is aligned with the upper end of the suspended fallpipe.

Preferably the fallpipe section handling means include a gripper adapted to grip a fall pipe section.

Preferably the fallpipe section handling means are adapted to bring the gripper to the engagement position in order to align the fall pipe section with the suspended fallpipe.

Preferably the gripper is adapted to allow for linear displacement of the fallpipe section with respect to the gripper.

Preferably the tower gimbal structure includes an arrangement of pivot members that form a stationary horizontal pivot axis.

In a possible embodiment the fallpipe section handling means are adapted to bring a fallpipe section to be added to the fallpipe in a position coaxial with said horizontal pivot axis, and then shift the fallpipe section towards the tower so as to engage the end of the fallpipe section with the head clamp. In said embodiment it is preferred that the fallpipe section handling means include a frame with a horizontal guide structure, the gripper being mounted on a gripper base slidable along said guide structure, the gripper being articulated with respect to the base in order to adapt the gripper position to the orientation of the fallpipe section.

In a preferred embodiment a further gimbal structure is provided between the tower and the fallpipe support. This allows for arresting of the pivotal motion of the tower during the actual stone dumping process, which is a preferred operating method for the inventive vessel. It is believed that during said stone dumping pivotal motions of the tower are undesirable, e.g. in order to be able to place a conveyor belt or the like for the stones above the upper end of the fallpipe. As the upper end of the fallpipe is suspended from the gimballing fallpipe support means during the actual stone dumping process, as is also a preferred operating method, which is then in a pivotal mode the upper end of the suspended fallpipe will be essentially unaffected by sea-state induced vessel motions, thereby limiting forces on the fallpipe.

In a preferred embodiment arresting means are provided allowing to arrest the pivotal motion of the tower, preferably during stone dumping as explained above.

In a preferred embodiment the further gimbal structure allows the tower to be in pivotal mode with respect to the suspended fallpipe, preferably during stone dumping as explained above.

In a preferred embodiment arresting means could be provided allowing to arrest the pivotal motion of the fallpipe support means with respect to the tower, e.g. during assembly and disassembly of the fallpipe as is a preferred method for these processes.

In a possible embodiment tilting means are provided which are adapted to tilt the tower between a substantially vertical operational position to a more horizontal inoperative position, preferably for the purpose of ROV handling in an area below the tower. For instance when the vessel is provided with a moonpool, both for suspending the fallpipe below said moonpool and lowering/retrieving an ROV via said moonpool, this tilting of the tower is advantageous.

More preferably, the vessel further comprises a telescopable pipe section. Such a telescopable pipe section preferably comprises at least an upper part and a lower part with deviating diameters allowing telescoping into each other. The telescopable pipe section can be stored on deck. Telescopable pipe sections are used to compensate for height differences of the bottom of the sea.

It is conceivable to install the telescopable pipe section between an ROV, positioned at the seabed, and the suspended fallpipe. In a preferred embodiment, the telescopable pipe section can be handled together with an ROV when the tower is tilted. Preferably, it is possible to store the telescopable pipe section partially in the tower.

Alternatively, the fallpipe support means comprise upper part support means for supporting the upper part of the telescopable pipe section, and the fallpipe section handling means comprise a clamp which is translatable up and down with respect to the tower, the clamp comprising cable support means for a cable supporting the lower part of the telescopable pipe section, wherein the lower part of the telescopable pipe section supports the suspended fallpipe, such that the length of the telescopable pipe section and thus of the suspended fallpipe is adjustable by lowering and raising the clamp.

In a possible embodiment one or more hydraulic cylinders are provided which engage on the tower, said hydraulic cylinders being adapted to perform at least one of the following tasks:

- active pivoting of the tower to obtain pivotal motion,
- dampen the pivoting tower motion,
- arrest the pivoting tower motion,
- tilting of the tower between an operative and inoperative position.

In a preferred embodiment, one or more rod linkage mechanisms are provided between the tower and a hydraulic cylinder, which rod linkage mechanism is releasable from a fixed position to a freely pivotable position, in which fixed position the hydraulic cylinders are adapted to perform at least one of the disclosed tasks, and in which freely pivotable position the rod linkage mechanism allows essentially undampened pivoting tower motion. This allows an easy switch between dampened and undampened motion with entirely releasing and disconnecting the hydraulic cylinder.

The vessel according to the invention concerns dumping of materials, in particular but not exclusively stones of various sizes, including rocks, and other suitable aggregate material.

The fallpipe may be deployed over the side of the vessel, or preferably from a moonpool.

The vessel according to the invention can be dimensioned suitable for stone dumping at large water depths, over 2000 meters.

Preferred fallpipe sections have a length of about 12 m.

The fallpipe may include fallpipe sections having special features, different from the bulk of the fallpipe sections.

For instance one or more telescopic fallpipe section may be provided, preferably to be mounted at the lower end of the fallpipe. It is envisaged that said one or more fallpipe sections may serve to adjust the position of the lower end of the fallpipe during stone dumping, e.g. to the seabed, e.g. to maintain a substantially constant distance to said seabed. The telescopic motion is preferably controlled by an ROV engaging or integrated in the lower end of the fallpipe.

It can also be envisaged to provide one or more fallpipe sections with one or more lateral windows for the entry of water into the fallpipe. Preferably said one or more fallpipe sections are to be used as upper fallpipe sections, to allow the entry of water as a downward water current is caused by the falling stones. It can also be envisaged to have a major section of the fallpipe composed of fallpipe sections with such lateral windows, e.g. to counteract segregation of the stones falling through the pipe.

The fallpipe may contain, but not preferred, sections which are not load transmitting interconnected themselves but are supported by one or more cables. Such sections supported by cables may in its simplest form be nestable bottomless buckets, or conical elements sliding into one another. Also the fallpipe could be construed as described in EP 0 668 211. A disadvantage of supporting the fallpipe by cables is that the cables are sensitive for water currents and may be susceptible to wear.

More preferably, the fallpipe sections are not supported by cables but are self-supporting as one end of a fallpipe section is directly mechanically interconnected with an end of an adjacent fallpipe section.

The fallpipe sections could be sophisticated polymer tubes, such as polyethylene pipe segments or glassfibre-reinforced polymer pipe segments. Possibly the plastic fallpipe sections are provided with metal end sections for interconnection with other fallpipe sections.

Adequate interconnection of self-supporting pipe sections is required, e.g. via a so-called collet connector, which is a subtype of chuck that forms a collar around the pipe section to be held and exerts a strong clamping force on the pipe section to be held when it is tightened via a tapered outer connector. An alternative self-supporting pipe assembly is described in NL 9100866.

An alternative interconnection of self-supporting pipe sections is achievable when the fallpipe sections have integral mechanical connectors, such as a bayonet connector. A new fallpipe is connectable to the upper pipe of the suspended fallpipe by positioning the new pipe above the suspended fallpipe and rotate the new fallpipe.

Preferably, the head clamp comprises a rotation device to rotate a fallpipe section clamped by the head clamp about its longitudinal axis, allowing the fallpipe section clamped by the head clamp to be connected to an adjacent fallpipe section of the suspended fallpipe by rotation of the fallpipe section. This is in particular beneficial when a bayonet-type of connector is used, or alternatively pipes having screw thread or the like.

A self-supporting fallpipe is in particular suitable for large water depths. The pivotal mode of the fallpipe assembly tower according to the invention allows the fallpipe to move independent from the vessel, especially during assembly and disassembly, reducing stresses on the mechanical connections between the pipe sections and in the pipe sections itself.

The fallpipe sections may be stored essentially horizontally or vertically. Preferably, the sections are stored horizontally along ship, optionally below deck level, in the hold of the vessel. Vertical guide rails may be provided on the walls of the hold for guiding the pipe sections. One or more gantry cranes may be provided to hoist the pipe sections out of the storage.

During stone dumping, a Remotely Operated Vehicle (ROV) is commonly used for manoeuvring the lower end of the fallpipe. The ROV is connected to the vessel via one or more ROV umbilicals. An ROV handling frame is preferably provided to guide the ROV during lowering and raising, e.g. through a moonpool, and to guide the ROV umbilicals.

One or more conveyors, e.g. belt conveyors are preferably provided on the vessel to supply stones to the fallpipe, e.g. via a funnel provided on the vessel above the upper end of the fallpipe. Said funnel could be mounted on the tower when the pivotal motion thereof is arrested.

The pipe support means are preferably designed as a clamp, which is preferably stationary mounted in a lower region of the tower, preferably positioned at the lower end of the tower, preferably near deck level.

More preferably, during stone dumping the pivotal motion of the tower is arrested and a further gimbal structure between the tower and the pipe support means is provided, allowing the tower to be in pivotal mode with respect to the suspended pipeline.

In an alternative the fallpipe support means can be disengaged from the tower and connectable to the hull while supporting the suspended fallpipe, such that once the fallpipe is built the assembly tower may be moved to a remote position, while the suspended fallpipe remains in position in the pipe support means. Even more preferably, a further gimbal structure is provided on the hull for the pipe support means when disengaged from the tower such that the pipe support means have a free-pivotal mode. This allows the pipe support means to have in the plane of said at least one pivot axis an orientation essentially independent from sea-state induced vessel motions.

Loading a new fallpipe section into the tower in its pivotal mode requires fallpipe section handling means adapted to said task.

As explained below referring to the drawings showing an example these fallpipe section handling means may be partly integrated with the tower (e.g. the head clamp as explained below) and partly be mounted on the vessel adjacent the tower.

It can also be envisaged that the fallpipe section handling means are distinct from the tower itself and are adapted to bring the fall pipe section to be advanced to the tower—during its advance to the tower—into an orientation aligned with the tower, said fallpipe handling means being provided with an automatic synchronising system which—during the advance of the fallpipe section to tower—causes a synchronised pivotal motion of the fallpipe section which is synchronised with the tower in its pivotal mode—at the latest as the fallpipe section reaches the tower—. The fallpipe section is then "transferred to equipment in the tower" e.g. placed in fallpipe section line-up tool which bring the lower end of the fall pipe section against the upper end of the suspended fall pipe.

A fallpipe vessel according to the invention can be dimensioned to dump stones at very great depths, e.g. at 2,500 meters depth or even deeper.

Further embodiments of the inventive fallpipe stone dumping vessel and operating methods are described in the description of the drawings.

The present invention further relates to a method wherein the inventive fallpipe stone dumping vessel is used.

The first aspect of the present invention also relates to a stone dumping system to be mounted on a fallpipe stone dumping vessel for stone dumping through a fallpipe suspended from the vessel, the system comprising:

- a fallpipe section storage for storing fallpipe sections,
- a tower at least comprising fallpipe support means for supporting the suspended fallpipe, said tower being adapted for assembly and disassembly of the fallpipe by addition of a fallpipe section to the upper end of the suspended fallpipe or removal of a fallpipe section from the suspended fallpipe, respectively,
- a tower gimbal structure adapted to be mounted between the hull of the vessel and the tower providing a pivotal mode for the tower wherein the tower is pivotable about at least one pivot axis with respect to the hull so that the tower—and the fallpipe suspended there from—has in a plane associated with said at least one pivot axis an orientation essentially independent from sea-state induced vessel motions,
- hoist means for lowering and raising the suspended fallpipe,
- fallpipe section handling means, adapted to—while the tower is in its pivotal mode—advance a fall pipe section to the tower and to bring said fallpipe section in alignment with the uppermost end of the suspended fallpipe in order to assemble the fallpipe and adapted to—while the tower is in its pivotal mode—disconnect a fallpipe section from the uppermost end of the suspended fallpipe and advance it to the storage in order to disassemble the fallpipe.

The invention further relates to a fallpipe vessel tower, fallpipe section handling means and fallpipe support means as described herein, as well as the use thereof in a method for assembly and disassembly of the fallpipe.

The present invention also relates to a fallpipe stone dumping vessel for stone dumping through a fallpipe suspended from the vessel, comprising:

- a hull,
- a fallpipe section storage for storing fallpipe sections,
- a fallpipe assembly system, e.g. including a tower, said fallpipe assembly system including at least fallpipe support means for supporting the suspended fallpipe,
- wherein one or more telescopic fallpipe sections are provided, preferably to be mounted at the lower end of the fallpipe, wherein said one or more fallpipe sections may serve to adjust the position of the lower end of the fallpipe during stone dumping, e.g. to the seabed, e.g. to maintain a substantially constant distance to said seabed, the telescopic motion preferably being controlled by an ROV engaging or integrated in the lower end of the fallpipe.

The present invention also relates to a fallpipe stone dumping vessel for stone dumping through a fallpipe suspended from the vessel, comprising:

a hull having a moonpool, a fallpipe section storage for storing fallpipe sections, a tower mounted on the hull above the moonpool, said tower being pivotal with respect to the vessel hull about at least one axis, wherein the tower is provided at a lower end thereof with fallpipe support means for supporting the suspended fallpipe, wherein the vessel includes a head clamp adapted to clamp an end of a fallpipe section, wherein the vessel is provided with hoist means connected to the head clamp so that the head clamp is translatable up and down along the tower e.g. for raising and lowering a fallpipe section or the fallpipe.

Preferably the head clamp has a main head clamp body and an articulated head clamp part that is adapted to clamp an end of a fallpipe section, wherein the vessel includes an actuator assembly allowing to bring the articulated head clamp part in an orientation allowing to connect said articulated head clamp part to a fallpipe section advance to the tower from the storage.

The present invention also relates to a stone dumping vessel fallpipe head clamp, said head clamp having a main head clamp body and an articulated head clamp part that is adapted to clamp an end of a fallpipe section, preferably an actuator assembly being associated with the head clamp allowing to bring the articulated head clamp part in an orientation allowing to connect said articulated head clamp part to a fallpipe section advance to the tower from the storage.

A second aspect of the present invention relates to a vessel according to another embodiment. This vessel could be a fallpipe stone dumping vessel but could also be another type of vessel, in particular a pipelaying vessel, such as a J-lay pipelaying vessel, for laying a pipe on the seabed, e.g. in the offshore oil and gas industry. In such pipelaying vessels it is also contemplated to assemble a pipe with a tower in pivotal mode in order to reduce the detrimental effects of sea-state induced vessel motions. The embodiment of provides an efficient manner to bring a new pipe section into alignment with the upper end of a pipe suspended from the tower into the water. It will be understood that the vessel of may include other features of the vessel according to the first aspect of the invention as desired.

A third aspect of the present invention relates to a vessel according to another embodiment. This vessel could be a fallpipe stone dumping vessel but could also be another type of vessel, in particular a pipelaying vessel, such as a J-lay pipelaying vessel, for laying a pipe on the seabed, e.g. in the offshore oil and gas industry. In such pipelaying vessels it is also contemplated to assemble a pipe with a tower in pivotal mode in order to reduce the detrimental effects of sea-state induced vessel motions.

The embodiment of provides an efficient manner to align the tower with the suspended pipe during assembly and disassembly of the pipe.

Ideally, the tower gimbal structure maintains the tower and the suspended pipe in a vertical orientation, while the hull pivots about the at least one pivot axis with respect to the tower. In practice, the pipe suspending from the tower and the tower may need active alignment. Factors interfering the ideal situation are the effects of inertia, friction which may occur in the at least one pivot axis, and possibly friction in cylinders for active pivoting or dampening, loads exerted by wind and current, the weight of the pipe sections, etc.

According to the preferred embodiment, additional pipe engagement means are provided in the tower at a distance from the clamp, which additional pipe engagement means withstand substantially lateral forces exerted by the suspended pipeline, such that the suspended pipeline exerts forces on the tower on two distinct areas, creating a moment of force on the tower during assembly and disassembly of the fallpipe. These areas may be relatively large or small. The areas are vertically spaced. Forces are exerted on the clamp or the pipe support means and on the additional pipe engagements means.

Preferably, the additional pipe engagement means comprise upper pipe engagement means and lower pipe engagement means. As such, the suspended pipeline exerts forces on three distinct areas. In a preferred embodiment, the upper and lower pipe engagement means operate sequentially. This is in particular beneficial when the pipe sections comprise thickenings, causing interruption of the pipe engagement by the pipe engagement means. It is beneficial for the pipe engagement means to comprise one or more rollerboxes, but alternative pipe engagement means, e.g. comprising endless tracks, are also conceivable.

A fourth aspect of the present invention relates to a vessel according to another embodiment. Compensating at least for the weight of the head clamp and maintaining the centre of gravity of the tower close to, preferably below, the at least one pivot axis of the tower gimbal structure, more preferably close to the point intersection of two intersecting pivot axes of the tower gimbal structure reduces unwanted moments on the tower and makes operation more reliable.

It is even more preferred to maintain the centre of gravity of the tower below the point intersection of two intersecting pivot axes of the tower gimbal structure. It is most preferred to maintain the centre of gravity of the tower in the point intersection of two intersecting pivot axes of the tower gimbal structure, or in the pivot axis of the tower gimbal structure.

By providing the centre of gravity of the tower below the one or more pivot axes of the tower, the forces necessary to align the tower with the fallpipe are reduced, whether those forces are caused by the fallpipe and/or a active pivoting system or otherwise.

In a preferred embodiment, the ballast comprises a liquid and the active ballast means comprise a pump. This also requires the presence of to liquid reservoirs, preferably water reservoirs.

A fifth aspect of the present invention relates to a pipe gripping assembly for handling a pipe, comprising at least one gripping member, wherein each gripping member comprises a pipe engaging portion engageable with a portion of the outer circumference of a pipe, and actuation means to move the gripping member such that said gripping member is movable between an open position for receiving a pipe and a closed position in which the pipe engaging portion engages with the pipe.

Pipe gripping assemblies are generally known. According to the fifth aspect, the pipe gripping assembly is characterised in that each gripping member is pivotable about a pivot axis perpendicular to the longitudinal axis of the pipe. Such construction is inherently safe, as the forces exerted by a pipe gripped by the pipe gripper generally do not occur in this direction. The main force exerted by a pipe in the pipe gripping assembly is directed downwards as a result of gravity, which may in conventional pipe gripping assemblies result in the undesired movement to the open position of the assembly. Moreover, the pipe gripping assembly according to the invention can be made more compact.

According to a preferred embodiment of the invented pipe gripping assembly the pipe gripping assembly further comprises a base portion engageable with a portion of the outer circumference of a pipe, opposite from the portion with which the at least one gripping member is engageable, from which base portion the at least one gripping member extends, in a direction perpendicular to the longitudinal axis of the pipe. As such, the pipe engaged by the pipe gripping assembly is engaged at at least two engagement points around its circumference: at the engagement point with the base portion and at the engagement point with the engagement portion of the gripping member.

Preferably, the gripping member is essentially C-shaped, one end of which being pivotably connected with the actuation means, and the engagement portion being provided at the other end.

Preferably, the actuation means comprise hydraulics.

Preferably, two opposite gripping members are provided, which are engageable with opposing portions of the outer circumference of the pipe. As such, the pipe engaged by the pipe gripping assembly is also engaged at at least two engagement points around its circumference: at the engagement points with the engagement portions of both opposite gripping members. Possibly, in combination with the base portion, the pipe gripping assembly may thus engage the pipe at three engagement points: also at the engagement point with the base portion.

Preferably, the opposite gripping members extend from opposite sides of the base portion. It is also conceivable to provide two pairs of opposite gripping members, resulting in four or five engagement points.

It is preferred to apply such pipe gripping assembly as part of the fallpipe section handling means or as pipe section handling means according to the first, second, third or fourth aspect of the invention. As such, preferably a gripper gimbal is provided between such a pipe gripping assembly and other pipe section handling means, to allow the pipe gripper assembly to rotate. The pivot axis of this gripper gimbal preferably is perpendicular to the longitudinal axis of the pipe, and even more preferably also to the pivot axis of the one or more gripping members. In a preferred embodiment, the pivot axis of the gripper gimbal intersects with the longitudinal axis of the pipe.

In this case, it is preferred for the pipe engaging portion to comprise rollers, allowing the (fall)pipe section to slide along the pipe gripper assembly and rotate about its longitudinal axis with respect to the pipe gripper assembly.

Thus, the invention also relates to a vessel with a system for assembly of a pipe to be lowered into the water and suspended from the vessel, the vessel comprising:

a hull, a pipe section storage for storing the pipe sections tower comprising pipe support means for supporting the suspended pipe, said tower being adapted for assembly of the pipe by addition of a pipe section to the upper end of the suspended pipe, a tower gimbal structure provided between the hull and the tower providing a pivotal mode for the tower wherein the tower is pivotable about at least one pivot axis with respect to the hull so that the tower—and the pipe suspended there from—has in a plane associated with said at least one pivot axis an orientation essentially independent from sea-state induced vessel motions, hoist means for lowering the suspended pipe, pipe section handling means adapted to—while the tower is in its pivotal mode—advance a pipe section to the tower and to bring said pipe section in alignment with the uppermost end of the suspended pipe in order to assemble the pipe, wherein the pipe section handling means comprise a gripper gimbal and a pipe gripping assembly for handling a pipe, which gripper gimbal is connected pivotably about a gripper gimbal pivot axis to the pipe gripping assembly, the pipe gripping assembly comprising at least one gripping member, wherein each gripping member comprises a pipe engaging portion engageable with a portion of the outer circumference of a pipe, which pipe gripping assembly further comprises actuation means to move the gripping member such that said gripping member is movable between an open position for receiving a pipe and a closed position in which the pipe engaging portion engages with the pipe, characterized in that each gripping member is pivotable about a pivot axis perpendicular to the longitudinal axis of the pipe, and in that the gripper gimbal pivot axis is perpendicular to the longitudinal axis of the pipe, and preferably also to the pivot axes of the one or more gripping members.

Preferably, the gripper gimbal pivot axis intersects with the longitudinal axis of the pipe.

Figure 1B:
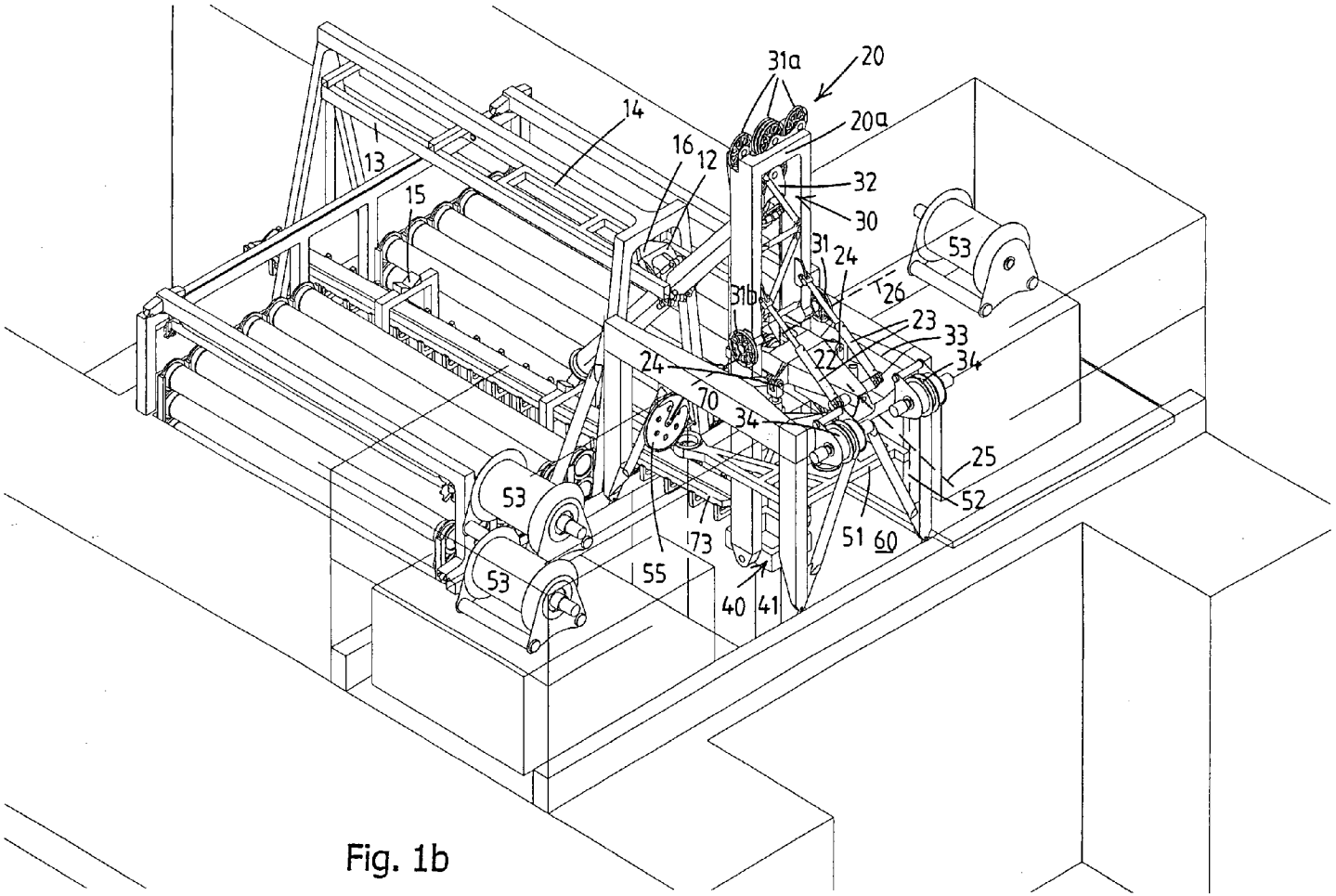
Figures 2A, 2B:
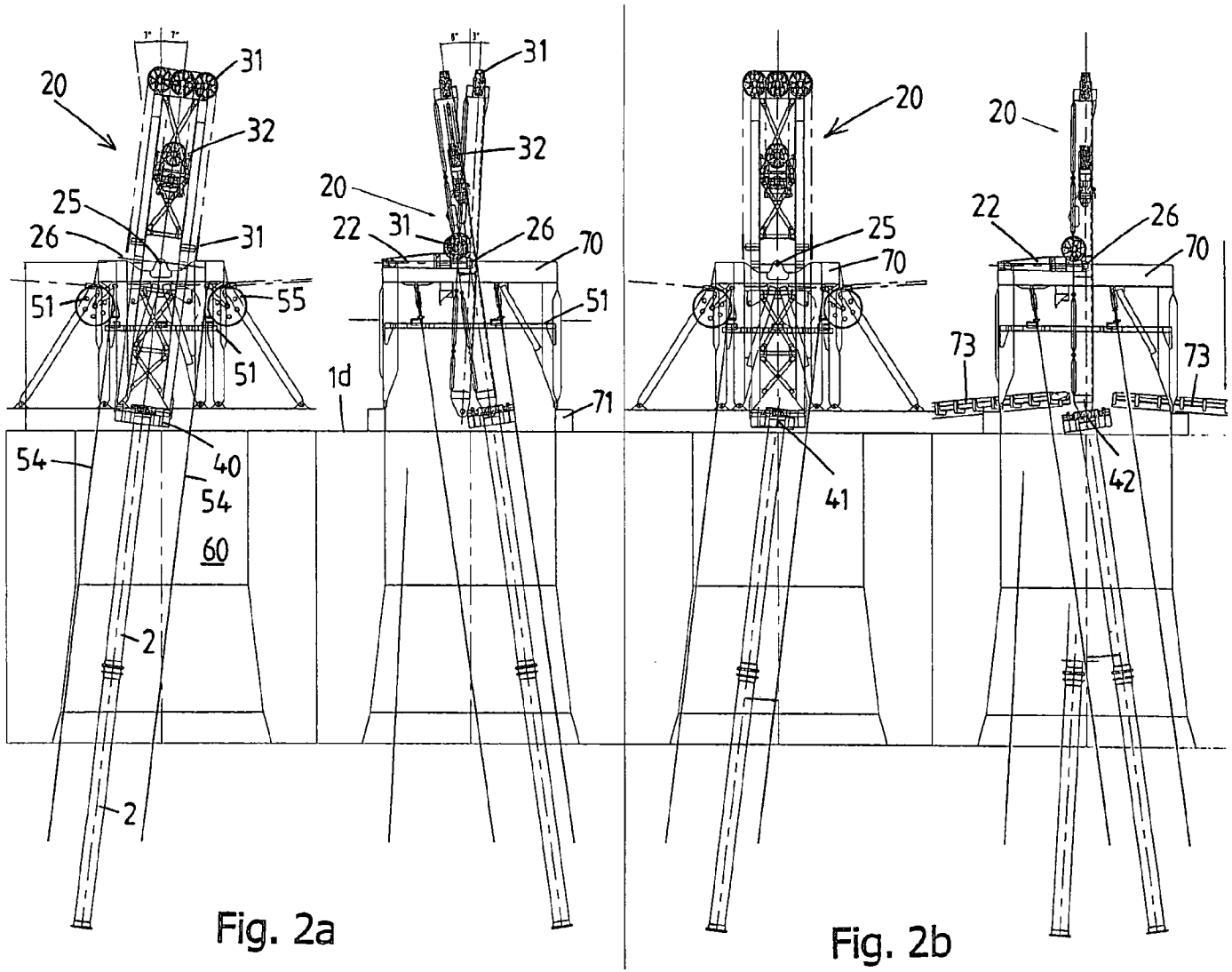
Figures 2C, 2D:
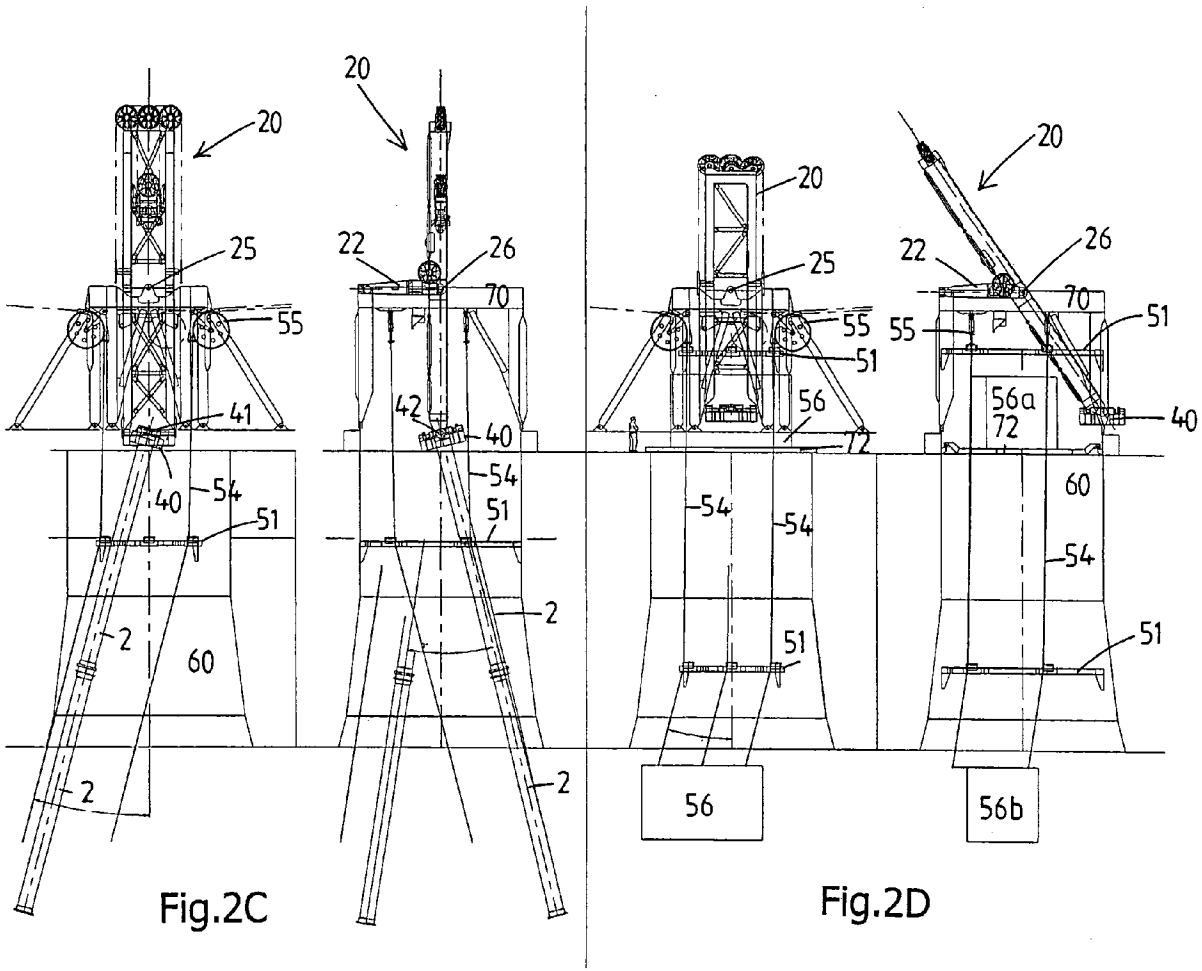
Figure 3:
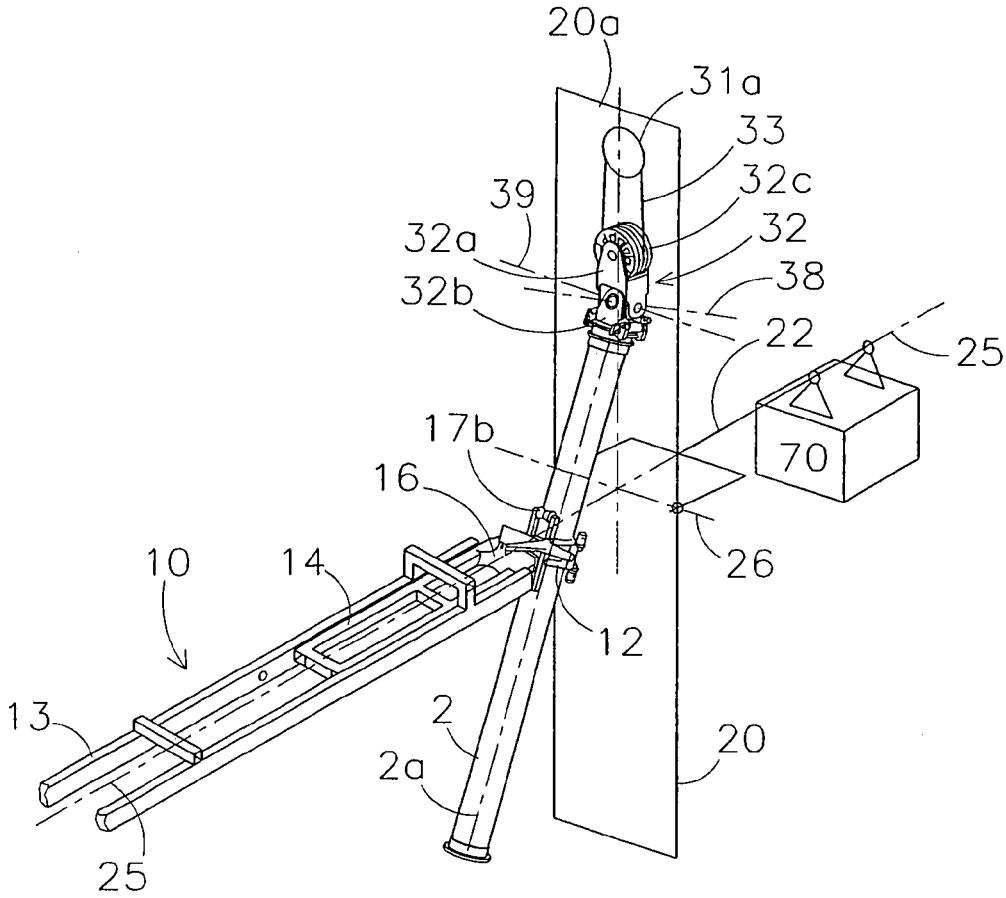
Figure 5A:
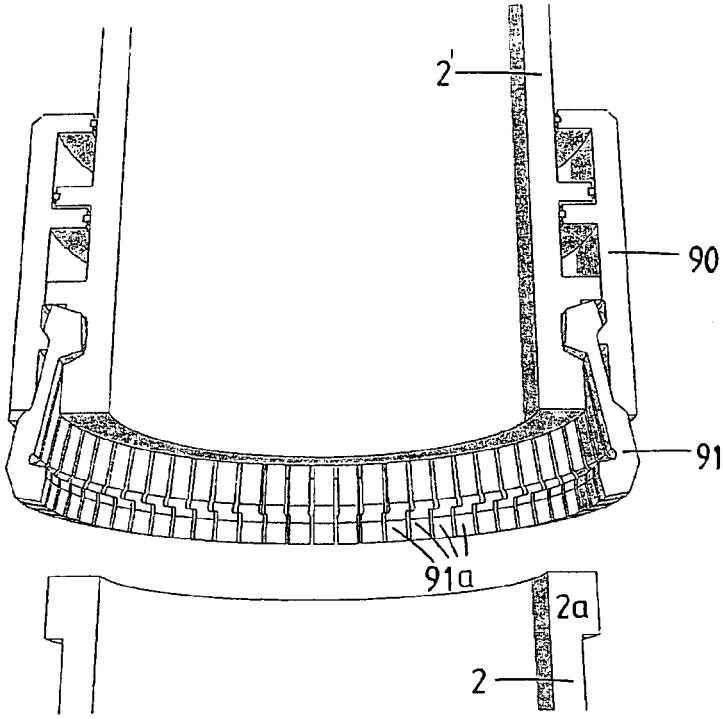
Figure 5B:
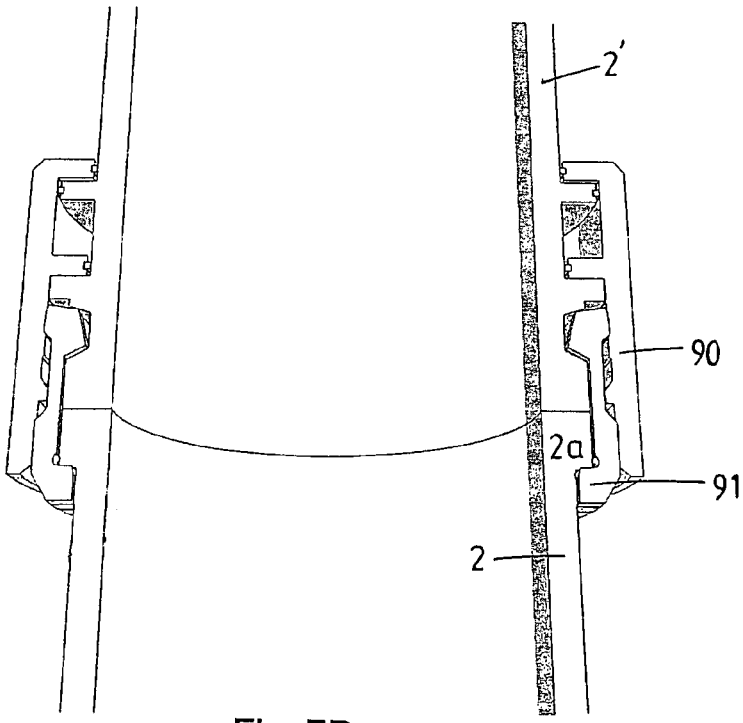
Figure 6A:
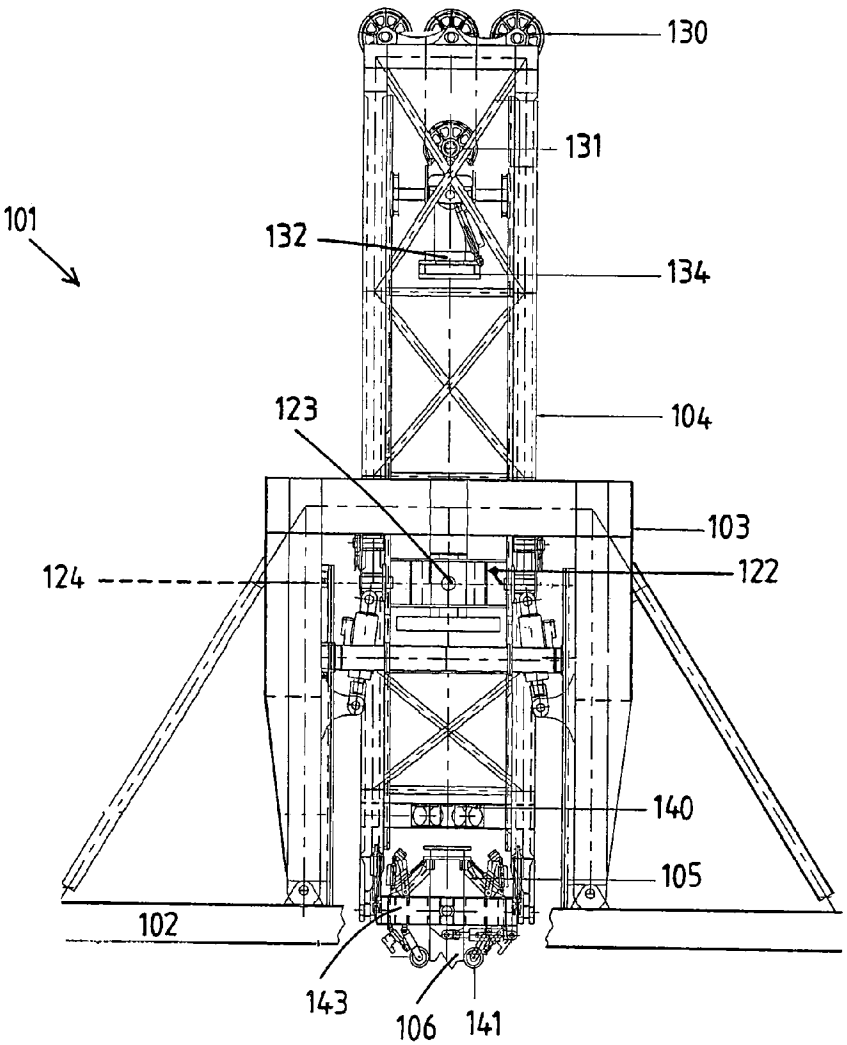
Figure 6B:
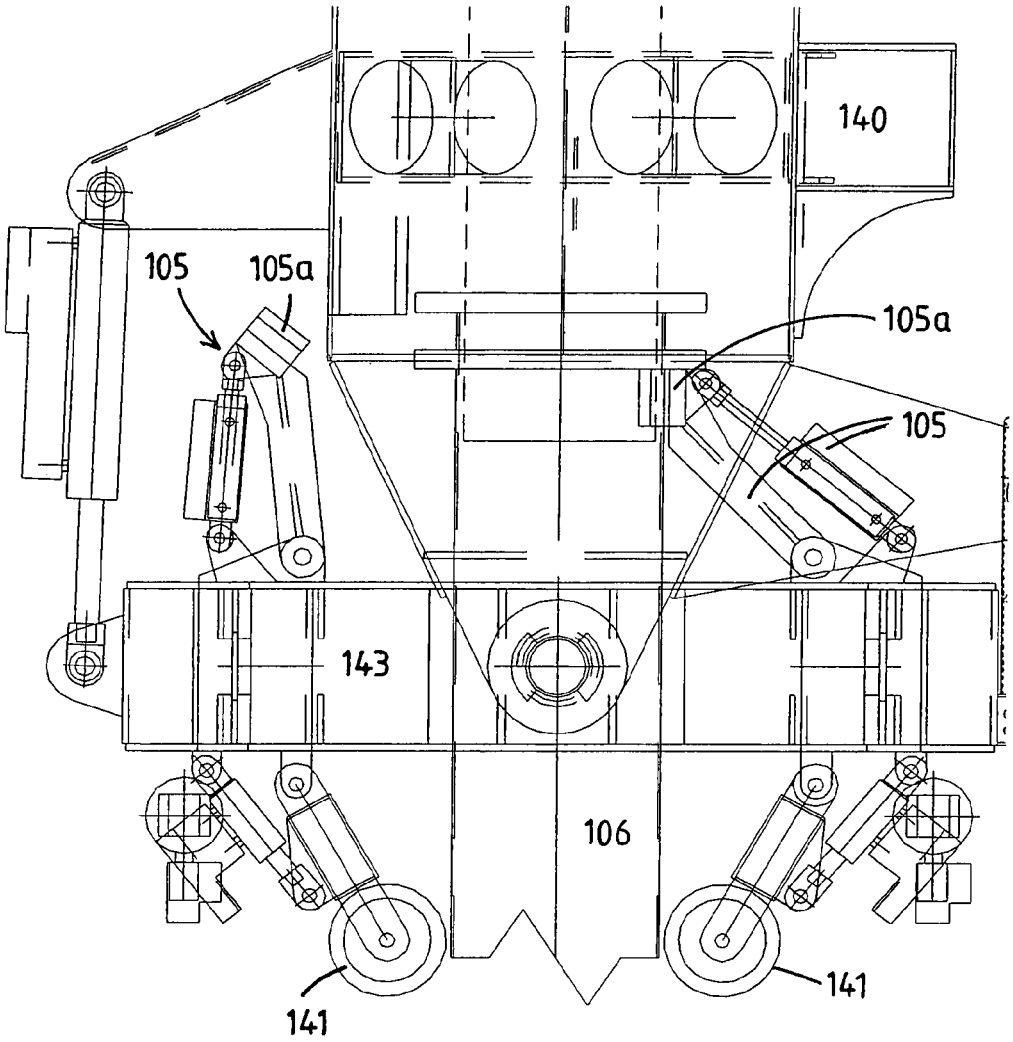

In the drawings:

FIG. 1*a* shows a perspective view of a mid-section of a preferred embodiment of a vessel according to the invention;

FIG. 1*b* a portion of FIG. 1*a* on a larger scale;

FIG. 2*a* shows a cross section of a fallpipe vessel according to the invention during assembly of the fallpipe;

FIG. 2*b* shows a cross section of a fallpipe vessel according to the invention during stone dumping;

FIG. 2*c* shows a cross section of a fallpipe vessel according to the invention during survival;

FIG. 2*d* shows a cross section of a fallpipe vessel according to the invention during ROV handling;

FIG. 3 shows schematically a part of preferred pipe handling means and a fallpipe assembly tower according to the invention;

FIGS. 4*a*-4*f* show the installation of a fallpipe wherein use is made of a vessel according to the invention;

FIGS. 5*a*-5*b* show an example of a collet connector allowing a self-supporting assembly of fallpipe sections;

FIG. 6*a* shows a cross section of a vessel according to a third aspect of the invention during assembly of a pipe;

FIG. 6*b* shows a detail of an alternative cross section of the vessel of FIG. 6*a;*

Figure 6C:
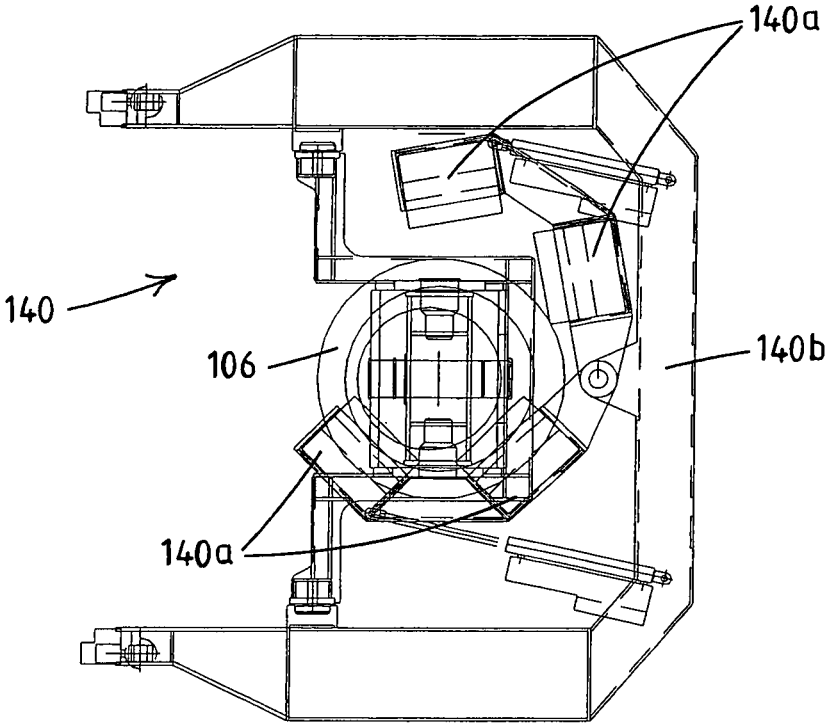

FIG. 6*c* shows a cross sections of sections E-E indicated in FIG. 6*b;*

Figure 8:
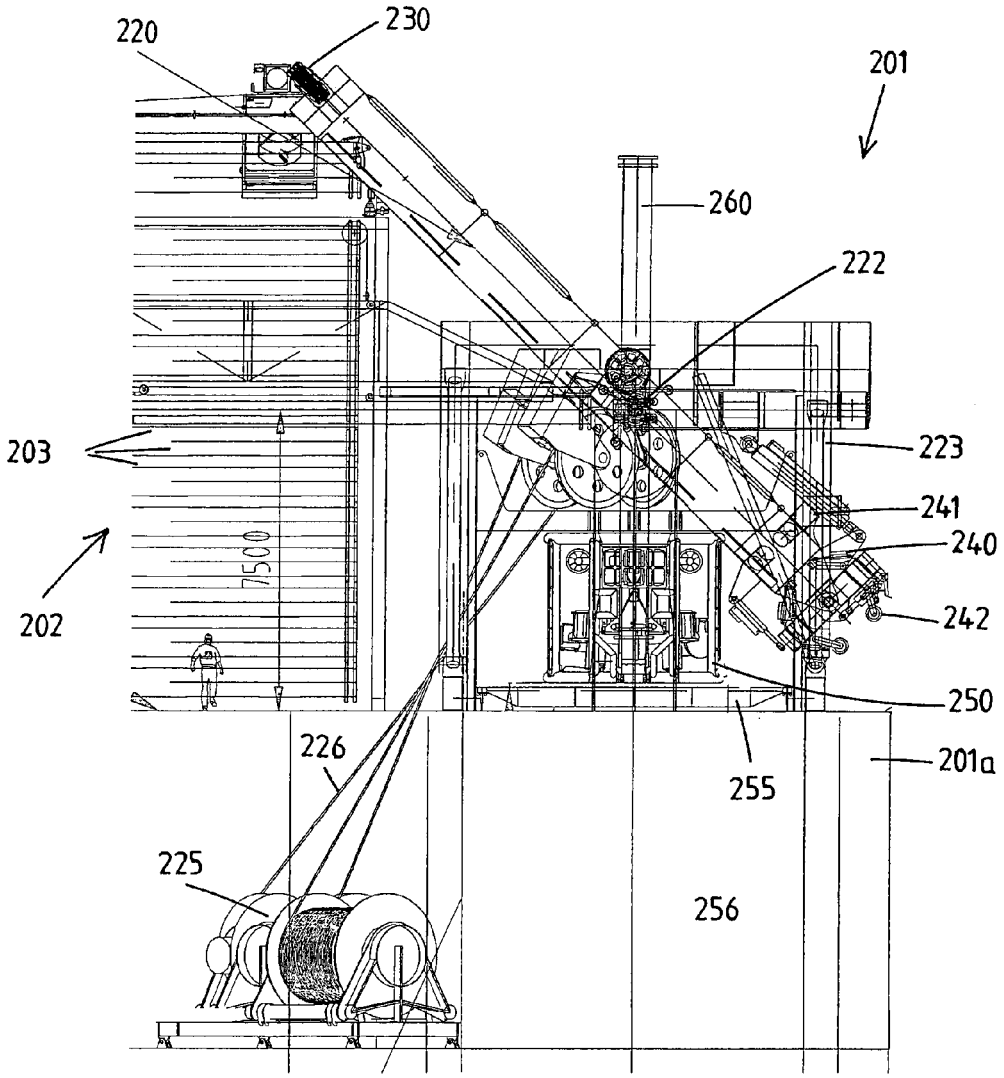
Figure 9A:
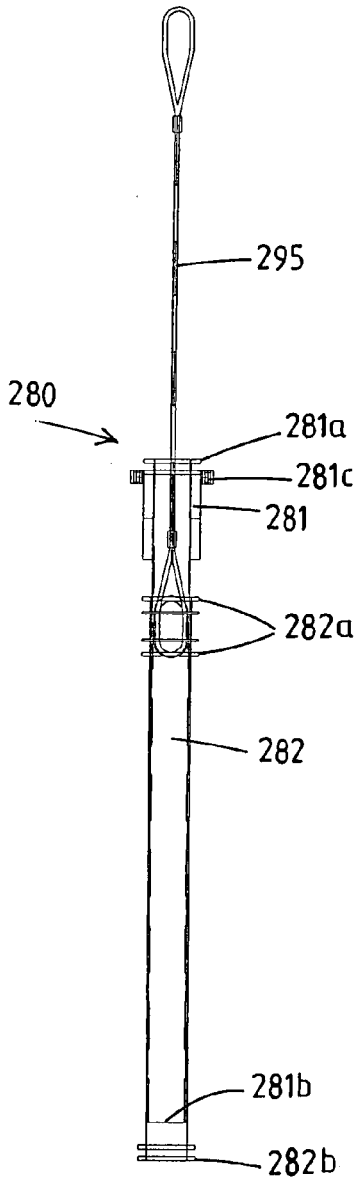
Figure 9B:
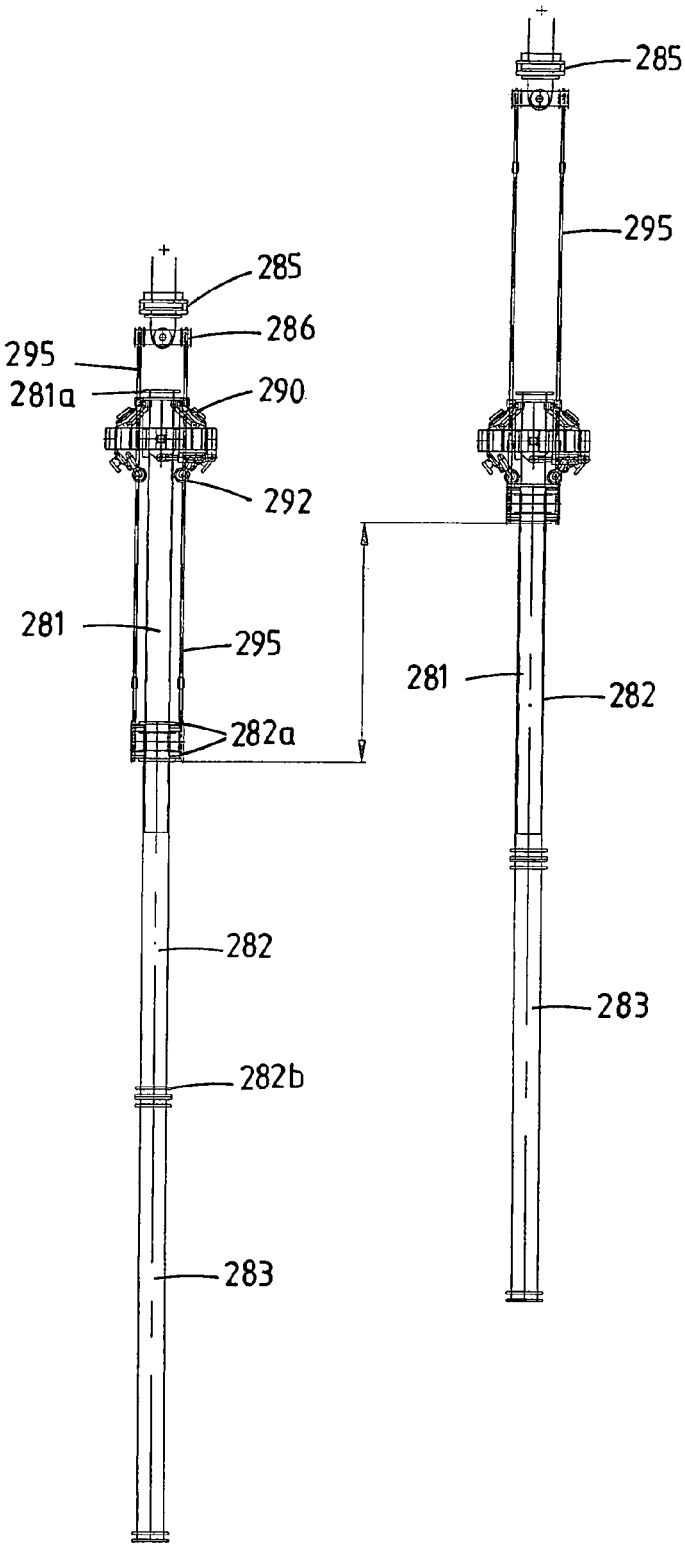
Figures 10A, 10B, 10C:
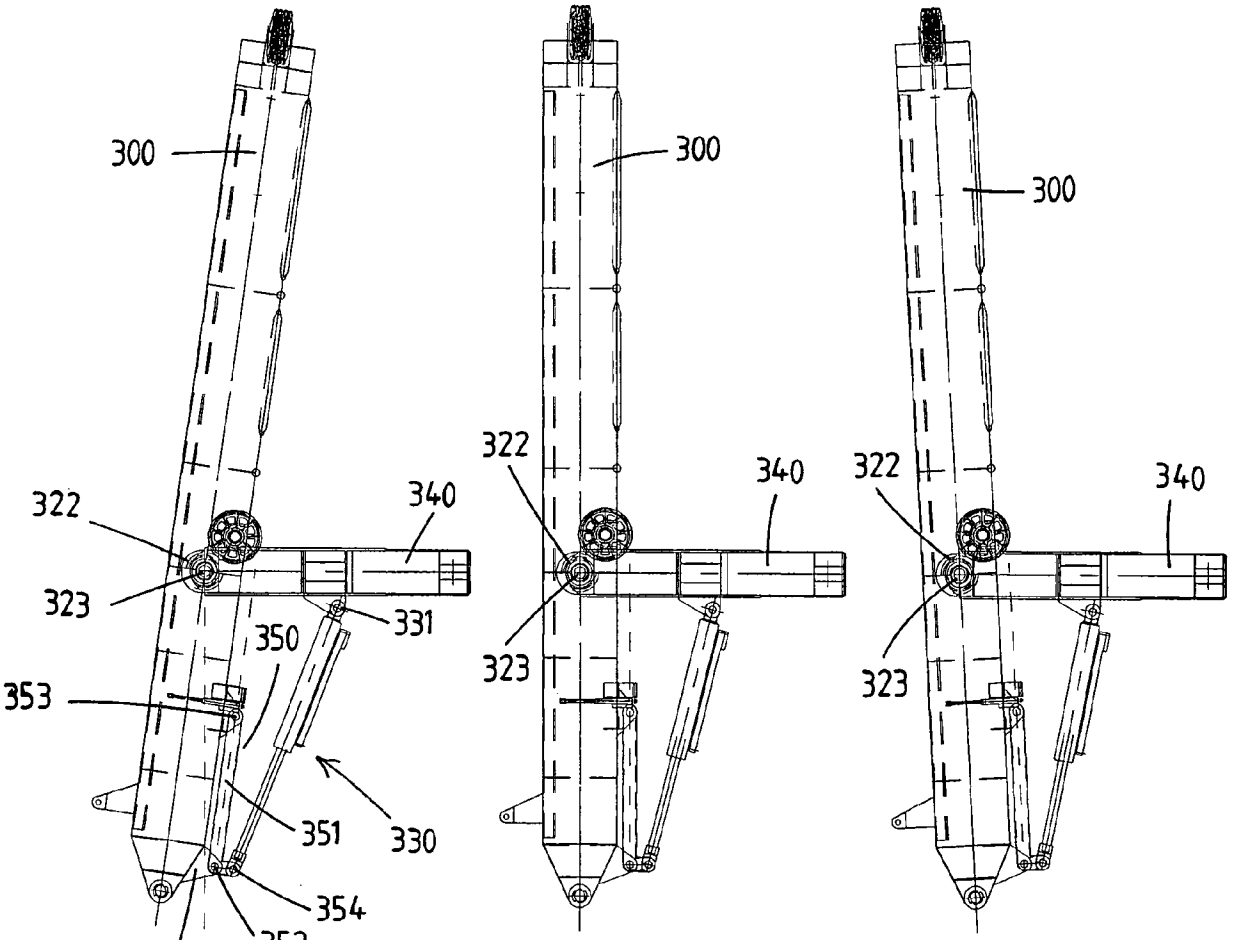
Figure 11C:
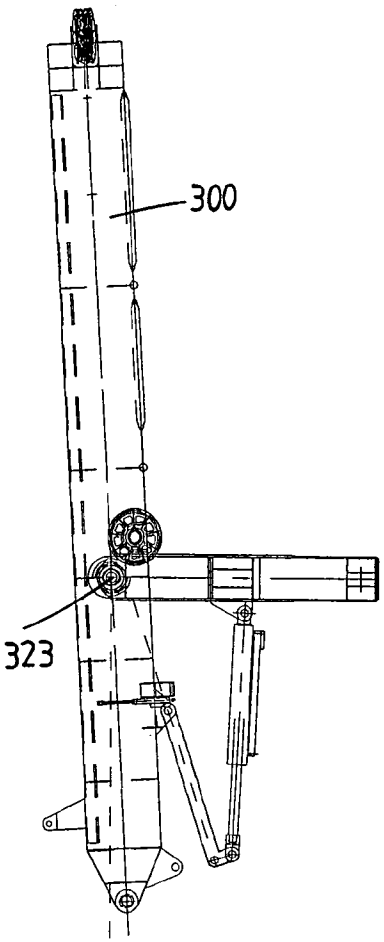
Figure 11B:
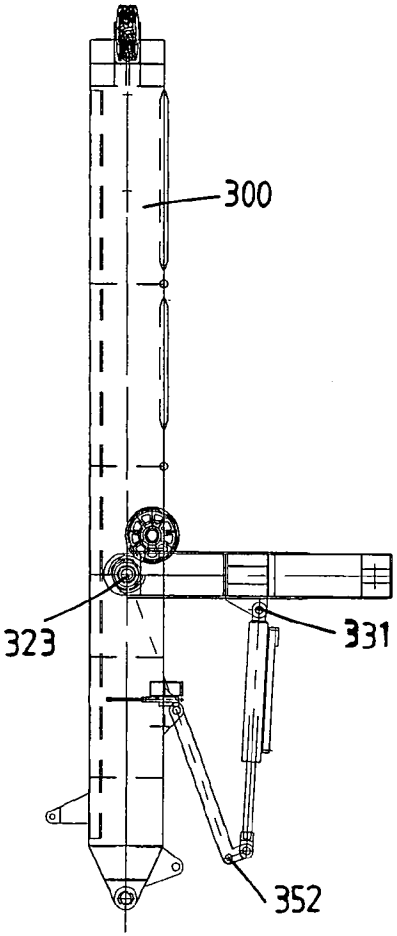
Figure 11A:
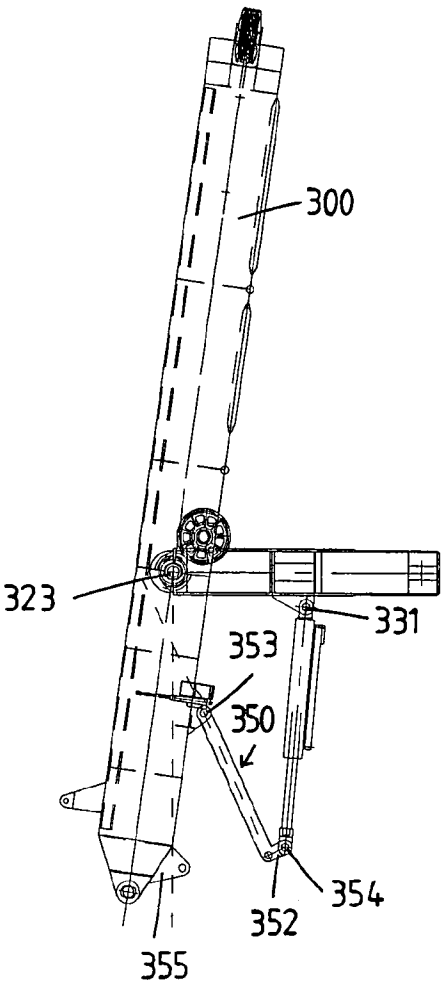
Figure 12A:
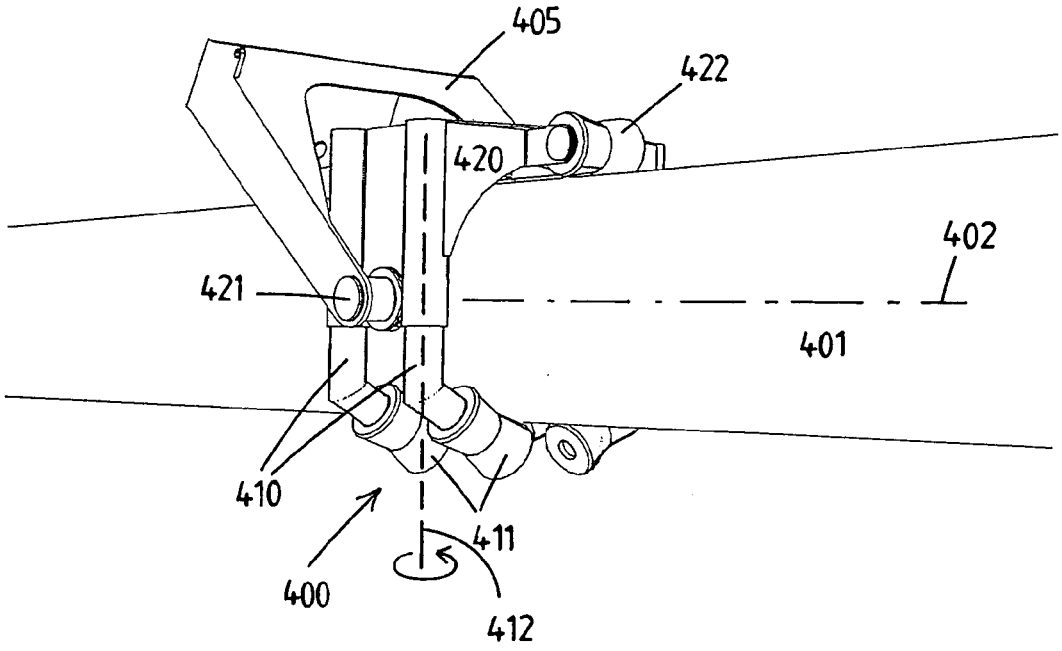
Figure 12B:
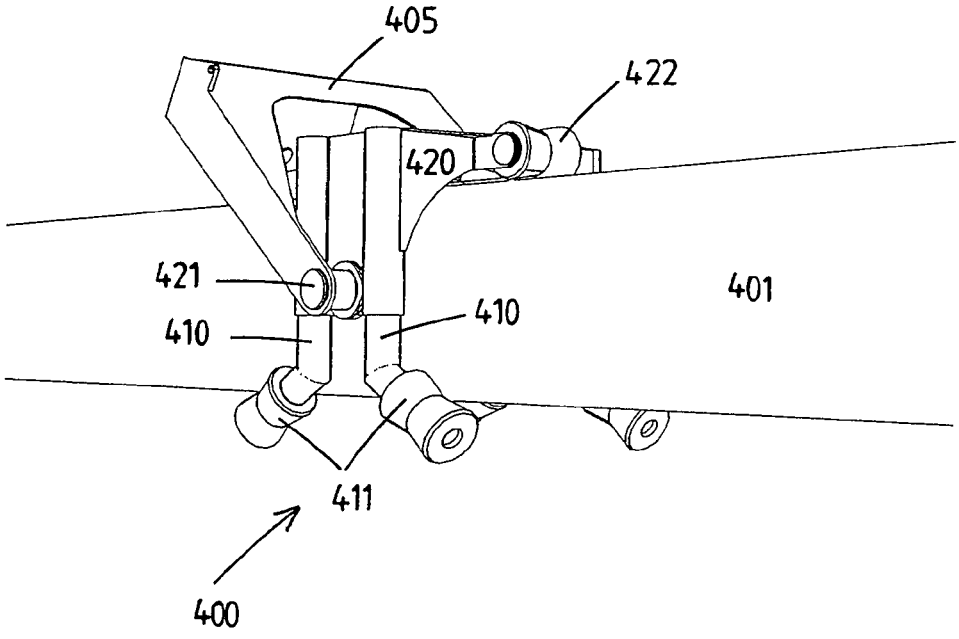
Figure 13A:
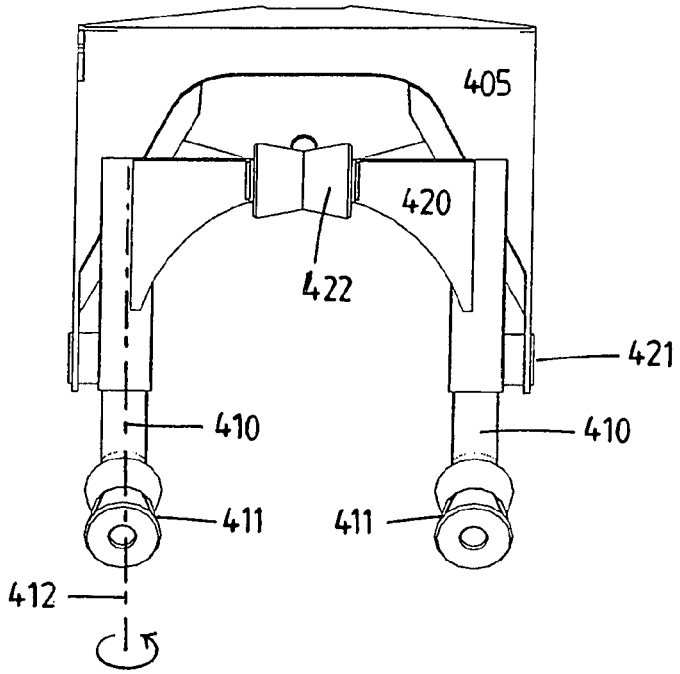
Figure 13B:
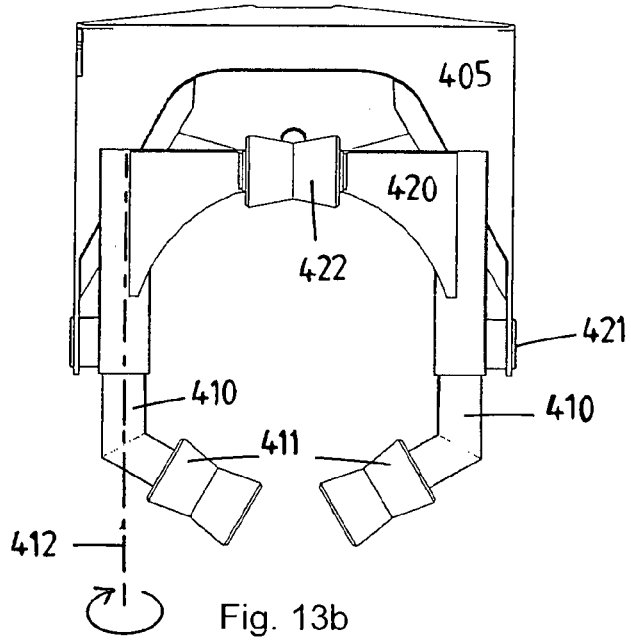
Figure 14A:
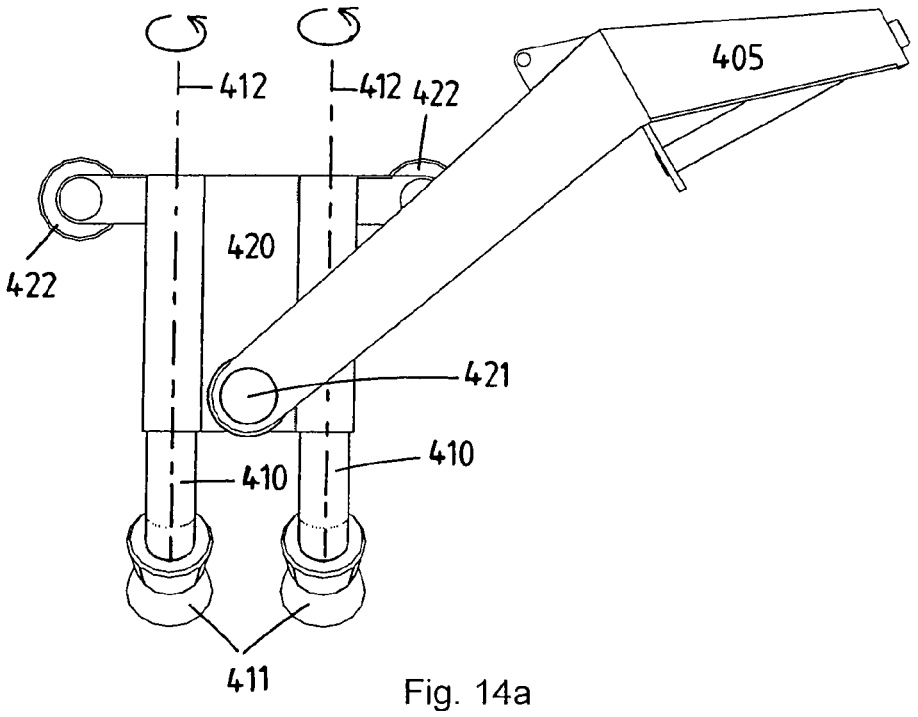
Figure 14B:
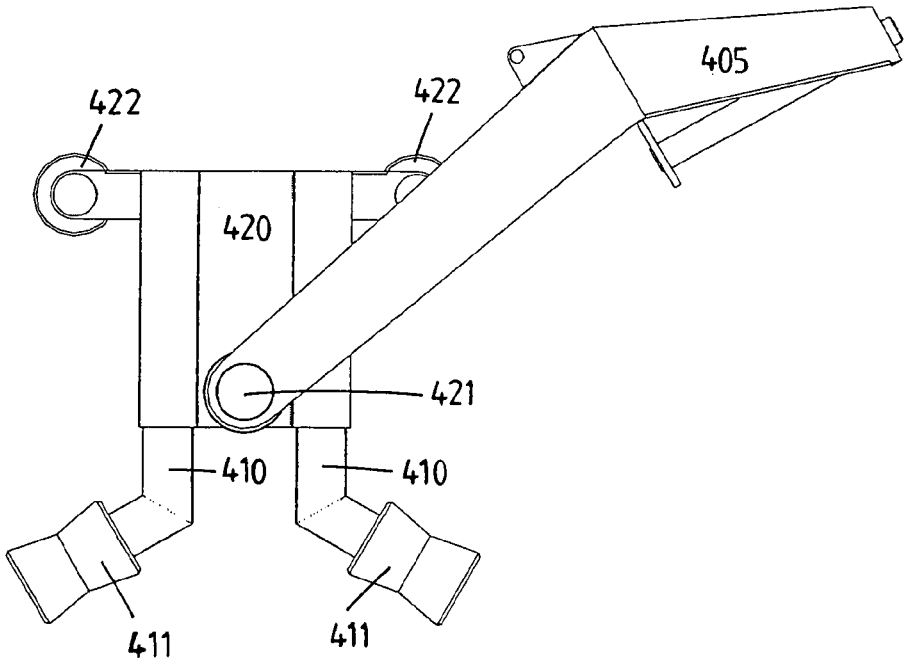

FIGS. 7*a*-7*j* show in cross section the lowering of a pipe with a vessel and an assembly according to the third aspect of the invention;

FIG. 8 shows a cross section of a portion of a vessel according to the first aspect of the invention;

FIG. 9*a* shows in cross section a preferred embodiment of a telescopable pipe section;

FIG. 9*b* shows in cross section the telescopable pipe section of FIG. 9*a* together with relevant portions of a tower;

FIGS. 10*a*-*c* show in cross section a preferred embodiment of a vessel according to the first aspect of the invention comprising a rod linkage mechanism in a fixed position;

FIGS. 11*a*-*c* show in cross section the preferred embodiment of FIG. 10 wherein the rod linkage mechanism is in a freely pivotable position;

FIGS. 12*a* and 12*b* show in a perspective view a preferred pipe gripping assembly according to the fifth aspect of the invention, which is gripping a pipe;

FIGS. 13*a* and 13*b* show the pipe gripping assembly of FIGS. 12*a* and 12*b* in a frontal view;

FIGS. 14*a* and 14*b* show the pipe gripping assembly of FIGS. 12*a* and 12*b* from a side view.

In FIGS. 1*a*, 1*b* a mid-section 1*a* of then hull of a fallpipe vessel 1 according to the invention is shown. Stones, rocks, and other suitable aggregate material can be stored in forward bunker 1*b* and aft bunker 1*c*. Fallpipe sections 2 are stored in racks 4, here horizontally as is preferred, in a fallpipe section storage 3, which is here arranged partly below deck level 1*d*.

The vessel has a moonpool 60. A tower 20 is mounted above the moonpool 60, here supported by a frame 70 which frame 70 is mounted on beams 71 attached to the hull structure. In this example the frame 70 comprises a horizontal U-frame assembly, resting on legs which extend downwards to the hull structure.

The tower 20 here has two parallel main tower beams, interconnected at their upper ends by a heavy cross member.

A two-axis tower gimbal structure 22, with pivot axis 25,26, is provided between the frame 70 and the tower 20 allowing the tower 20 to have a pivotal mode wherein the tower 20 is pivotable with respect to the frame 70 on vessel 1 so that the fallpipe assembly tower 20, and the fallpipe suspended there from—has an orientation essentially independent from sea-state induced vessel motions.

In the tower, here on the cross member 20*a*, sheaves 31*a* are mounted. Also in the tower 20 a head clamp 32 is provided, having a main head clamp body 32*a* provided with one or more sheaves 32*c*. One or more cables 33 extend between the head clamp 32 and the sheaves 31*a* on the tower. These one or more cables 33 extend to one or more hoist winches 34, the arrangement of said one or more winches 34, cable(s) 33 and head clamp 32 being capable to lower and raise the fallpipe when the upper end is connected to the head clamp 32.

Preferably the tower is provided with one or more guide rails for the translating head clamp.

As is preferred the one or more, here two winches 34 are mounted stationary (thus not on the tower), here on the frame 70, one or more further sheaves 31*b* (here positioned on the main beams of the tower near the axis 26) guiding the cable(s) 33 to the winche(s) 34. An arrangement of sheave(s) near the axis 26 reduces the impact of pivotal tower motions on the tension in the cable 33.

At the lower end of the tower 20 a fallpipe support means 40 is mounted (only its position shown in the drawings), which is preferably configured as a clamp engaging on an upper end of the fallpipe, e.g. on a collar 2*a* (such as a hang-off clamp in pipelaying vessels) allowing to hold the suspended fallpipe. It will be understood that the weight of the fallpipe is transferred via the support means 40 to the tower 20 and then via frame 70 to the hull of the vessel.

As is preferred the fallpipe support 40 is mounted on the tower 20 via a two-axis gimbal structure. Arrest means are provided that allow to arrest the support 40, rendering the gimbal structure ineffective, when desired.

The head clamp 32, cables 33, sheaves 31*a*,*b*,32*c* and winches 34 (here generally indicated as hoist means 30 for raising and lowering the suspended fallpipe) have the capacity to hold the entire fallpipe and raise and lower the fallpipe as desired, when the fallpipe is not supported by the support means 40 (primarily during fallpipe lowering/raising steps in the assembly/disassembly processes of the fallpipe).

The head clamp 32 is configured to clamp or otherwise engage with an end of a fallpipe section 2 and is translatable up and down along the tower. Here, as is preferred, the head clamp 32 includes an articulated engagement head clamp part 32*b* which is adapted to be brought into engagement with said end of the fallpipe section. Articulation may involve a gimbal joint between the parts 32*a*,*b*, preferably having two axes. Also an actuator assembly may be provided to govern the articulation, e.g. one or more hydraulic actuators in the head clamp. The actuator assembly may also be remote from the head clamp, e.g. at a position along the tower or on the gimbal structure.

During stone dumping a ROV 56 is used for handling/manoeuvring the lower end of the fallpipe. The ROV 56 can be stored in ROV storage 50. An ROV handling frame 51 is provided within frame 70 to guide the ROV through the moonpool 60 during lowering and raising, and to guide ROV umbilicals 54.

Winches 53 and sheaves 55 for the ROV umbilicals 54 are indicated. These sheaves 55 are located at a height above deck level to allow the ROV to be placed under them and to prevent interference of the sheaves with the tower in its free-pivoting mode. ROV handling frame 51 is moveable in vertical direction via guide rails 52 on the legs of the frame 70.

A moonpool hatch 72 is provided, allowing to cover the moonpool 60. The hatch 72 can have a single or multiple hatch parts moveable between a position over the moonpool 60 and a remote position, shown in FIG. 1 under ROV storage 50. Such a moonpool hatch 72 can be positioned across the moonpool during stone dumping, leaving the top end of the fallpipe open to receive stones from a stone conveyer 73. During fallpipe installation, and during lowering and raising of an ROV, the moonpool hatch 72 is moved to its remote position.

In general terms the vessel comprises fallpipe section handling means which are adapted to—while the tower 20 is in its pivotal mode—advance a fall pipe section 2 to the tower 20 and to bring said fallpipe section 2 in alignment with the uppermost end of the suspended fallpipe in order to assemble the fallpipe and adapted to—while the tower 20 is in its pivotal mode—disconnect a fallpipe section 2 from the uppermost end of the suspended fallpipe and advance it to the storage in order to disassemble the fallpipe.

As will be understood, in this preferred embodiment, the hoist means 30 effectively form part of said fallpipe section handling means, but in other (not shown) designs the hoist means would not form part of said fallpipe section handling means.

In the shown embodiment, vessel mounted fallpipe handling means 10 comprise a stationary frame 11 along which a loader hoist frame 13 is moveable in vertical direction. Loader hoist frame 13 comprises gripper base or extension frame 14 to which a gripper 12 for a fallpipe section 2 is connected. The gripper base or extension frame 14 is moveable in a in a horizontal direction along loader hoist frame 13.

A gimbal 16 here is provided between the gripper 12 and extension frame 14, so that the gripper 12 is allowed to pivot together with the fallpipe section as its end is raised by means 20 of the head clamp and the tower performs pivotal motions.

The operation of the vessel mounted pipe handling means 10 will be explained in further detail below. The pipe sections are brought to a loading position in which the fallpipe section lies horizontally on pipe buffers 15 via a pipe crane 80 provided on pipe crane support 82. A pipe crane spreader beam 81 is provided to pick up the pipe sections.

In an alternative embodiment (not shown) pipe sections are stored on deck. This allows an elevated position of the pipe buffers, preferably essentially at the level of he gimbal structure with one or two pivot axes. An elevated pipe crane may be provided to pick up the pipe sections and position these on the pipe buffer. The pipe sections may subsequently be moved in a transverse direction, e.g. to the pick up position, such as in the direction of a gripper, by hydraulically operated buffer arms.

In FIG. 2*a* a cross section of the fallpipe vessel 1 according to the invention is shown during assembly of the fallpipe. In moonpool 60 two connected fallpipe sections 2 are shown, and two ROV umbilicals 54 extending downwards from ROV sheaves 55 through ROV handling frame 51. The upper fallpipe section 2 is supported by fallpipe support means 40 at the lower end of tower 20. Gimbal 22 (not shown per se) enables a pivoting movement of the tower 20. Preferably during assembly of the fallpipe, the support 40 is arrested, so unable to gimbal.

In FIG. 2*b* a preferred mode of the vessel according to the invention is shown during stone dumping. When a desired fallpipe length is reached, the arresting of the pipe support means 40 with respect to the tower can be released in this embodiment. The fallpipe is then suspended from the fallpipe support means 40 at the lower end of the tower, here at about deck level. The fallpipe assembly tower 20 is now preferably arrested in its vertical position with respect to frame 70 on the vessel by hydraulic cylinders 23, 24, while pipe support means 40 are set in a free-pivotal mode that allows the support means 40 to freely pivot about axes 41,42 with respect to the tower. Stresses in the fallpipe are minimized due to this gimballing fallpipe support means 40, allowing the fallpipe to freely pivot with respect to the vessel. In an operational mode, the largest angle of the fallpipe with respect to the vertical of the ship may be 7° (depending on design of the moonpool). A funnel for receiving stones may be placed in the upper end of the fallpipe and conveyors 73 for carrying stones are skidded into position so as to deliver stones or other aggregate material to the fallpipe. During assembly of the fallpipe, these conveyors 73 are preferably moved or skidded away from the moonpool to prevent interference with the tower 20 and the pipe sections 2.

In FIG. 2*c* a cross section of a fallpipe vessel according to the invention in a survival mode is shown. The system can be brought in survival mode when adverse environmental conditions are met during operation. In moonpool 60 two connected fallpipe sections 2 are shown, and two ROV umbilicals 54 extending downwards from ROV sheaves 55 through ROV handling frame 51. The upper fallpipe section 2 is supported by fallpipe support means 40, brought in a free-pivotal mode (pivotable about axes 41, 42) at the lower end of fixed tower 20. The largest angle of the fallpipe with respect to the vertical of the ship may reach up to 15°, the fallpipe then just stays clear of the moonpool 60. However, to prevent interference of the fallpipe with the ROV umbilicals and interference of the ROV umbilicals with the moonpool the deflection point of the ROV umbilicals must be brought down into the moonpool. The ROV umbilicals are preferably routed through guide rings in the ROV handling frame 51. In the uppermost position of the ROV handling frame the umbilicals stay almost entirely clear of these guide rings during normal operation. To bring down the deflection point of the ROV umbilicals into the moonpool in the survival mode, the ROV handling frame is lowered into the moonpool. The umbilical guide rings of the ROV handling frame then deflect the umbilicals at that height. The ROV handling frame cannot be brought to its lowest position because it will then interfere with the pipe string. The lower part of the moonpool is preferably somewhat flared to prevent collisions with the fallpipe and/or the ROV umbilicals.

In FIG. 2*d* a cross section of a fallpipe vessel according to the invention during ROV handling is shown. The lower end of the fallpipe is handled by an ROV. Before the fallpipe is build the ROV is brought in position above the moonpool and then lowered with the fallpipe. Initially the ROV is stored in storage 50 (see FIG. 1) at the side of the moonpool 60 where it can be serviced. When the ROV is in this position the tower 20 is tilted, using hydraulic cylinders, about pivot axis 26 to a tilted position, so that the area above the moonpool 60 is cleared. The moonpool hatch 72 is now placed over the moonpool 60. Two positions of ROV 56 and ROV handling frame 51 are shown in the figures: one in which the ROV is skidded on the moonpool hatch 72 and suspended from ROV umbilicals 54 from sheaves 55. In the other position after retraction of the moonpool hatch 72 the ROV 56 is lowered into the moonpool 60. ROV handling frame 51 is guided by guide rails 52 (shown in FIG. 1) which extend downward along the walls of the moonpool 60 and is lowered together with the ROV 56 to prevent collisions between the ROV 56 and the walls of the moonpool 60. Now the fallpipe can be build up through a centre passage of the ROV. During building of the first fallpipe section, preferably the tower 20 is kept fixed vertically with respect to the vessel, at least until the ROV is clear of the underside of the vessel and the ROV handling frame is raised to its upper position above deck level. After that the tower is allowed or made to pivot with respect to the vessel in order to counter sea-state induced vessel motions.

When the fallpipe has to be disassembled the ROV can be raised. The procedure is then performed in reverse order. When the fallpipe is short enough the tower is again arrested with respect to the vessel. After the last fallpipe section has been removed from the tower the tower is tilted, clearing the area above the moonpool. The ROV handling frame is lowered to its lowest position in the moonpool. The ROV 56 is pulled against the ROV handling frame 51 and hoisted up through the moonpool. When the ROV is above deck level the moonpool hatch is skidded under the ROV and the ROV is lowered onto the hatch. The ROV can than be skidded to its storage position. In a particular embodiment, the moonpool remains open when the ROV is its storage position as the moonpool hatch is skidded with the ROV into the ROV storage.

In FIG. 3 the relevant parts of preferred vessel mounted pipe handling means 10 and of the tower 20 are shown in a very schematical manner. Tower 20 is connected via a gimbal structure 22 and via frame 70 to the hull of the vessel 1. Thereby pivot axis 25 is a stationary pivot axis which is stationary with respect to the hull. Head clamp 32 is adapted for clamping an end of a new fallpipe section, which head clamp 32 is translatable up and down within the tower via cables 33 passing over sheaves 31*a,b* and 32*c*. The head clamp 32 here includes a gimbal joint, such that the clamped fallpipe section 2 is freely pivotable with respect to the tower 20 about pivot axes 38, 39.

Loader hoist frame 13 with extension frame 14 and gripper 12 has been moved to bring new pipe section 2 into alignment with the stationary pivot axis 25. New fallpipe section 2 has been brought into engagement with the head clamp 32, by moving extension frame 14 in a in a horizontal direction along loader hoist frame 13. Gripper gimbal 16 provided between gripper 12 and extension frame 14 allows the gripper 12 to rotate. The gripper 12 comprises rollers 17*a* allowing the fallpipe section 2 to slide along the gripper and rotate about rotation axis 2*a* with respect to the gripper 12.

FIGS. 4*a*-4*f* show the installation of a fallpipe wherein use is made of a vessel according to the invention. Visible are vessel mounted pipe handling means 10 with stationary frame 11 along which a loader hoist frame 13 is moveable in vertical direction to bring the new fallpipe section 2 into alignment with the stationary pivot axis 25 of the gimbal structure.

Loader hoist frame 13 comprises extension frame 14 to which gripper 12 is connected. Extension frame 14 is moveable in a in a horizontal direction along loader hoist frame 13 to shift the new fallpipe section into engagement with the head clamp 32. Gripper rollers 7*b* are also visible. Fallpipe sections 2 are stored in a fallpipe section storage 3.

Fallpipe support means 40 are provided for supporting the weight of the previously suspended fallpipe. The fallpipe assembly tower 20 is in a free-pivotal mode wherein the fallpipe assembly tower 20 is freely pivotable with respect to the hull of the vessel 1 via gimbal 22 so that the fallpipe assembly tower 20 has in the plane of the pivot axes 25, 26 of gimbal 22 an orientation essentially independent from sea-state induced vessel motions. Cylinder pairs 23 may dampen some of the movements or fix the tower 20 in a tilted orientation.

Figure 4A:
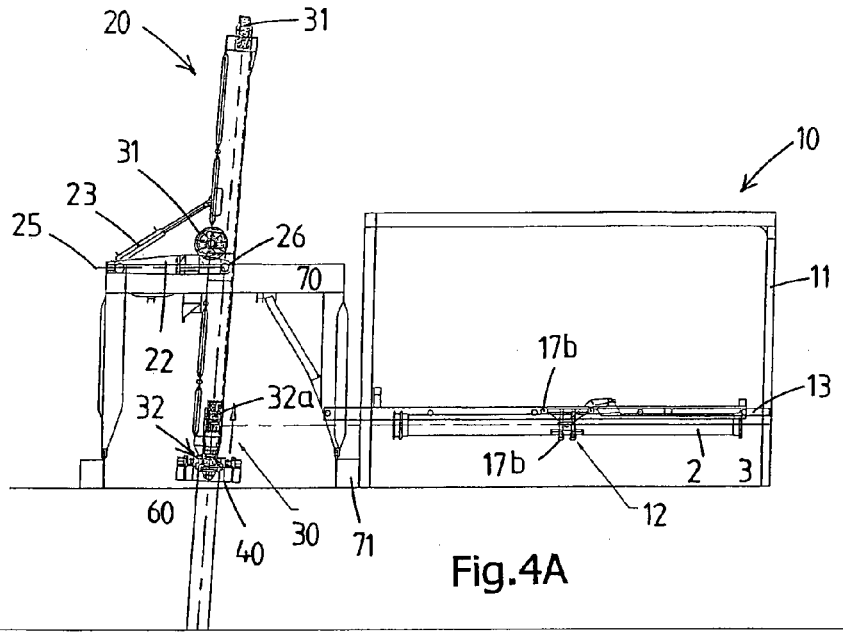

In FIG. 4*a* a horizontal fallpipe section 2 is gripped at about its centre of gravity by gripper 12. Head clamp 32 is in the lowest possible position in the tower 20, just above fallpipe support means 40, and is moved upwards in the tower via cables (not shown) and sheaves 32*a* and 31.

Figure 4B:
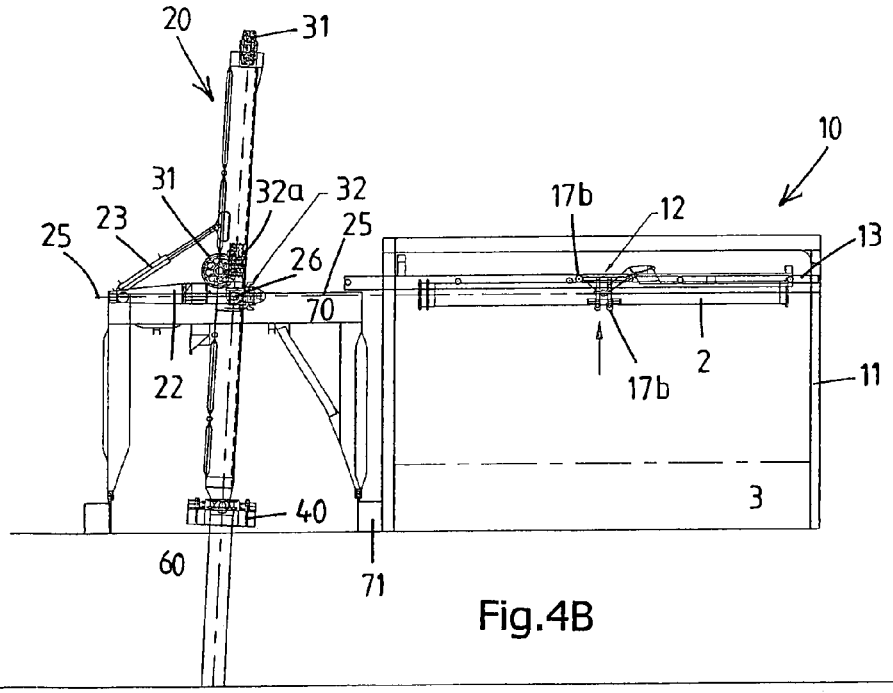

In FIG. 4*b* this fallpipe section 2 is raised in horizontal position together with gripper 12 and loader hoist frame 13 along stationary frame 11, until the fallpipe section 2 is at the level of the tower pivot axis 25. Head clamp 32 is moved upwards until an engagement position is reached at the stationary pivot axis 25, in which the head clamp 32, in particular the articulated engagement part 32*b*, is positioned in an engagement orientation in which the clamp 32 can receive and engage a fallpipe end.

Figure 4C:
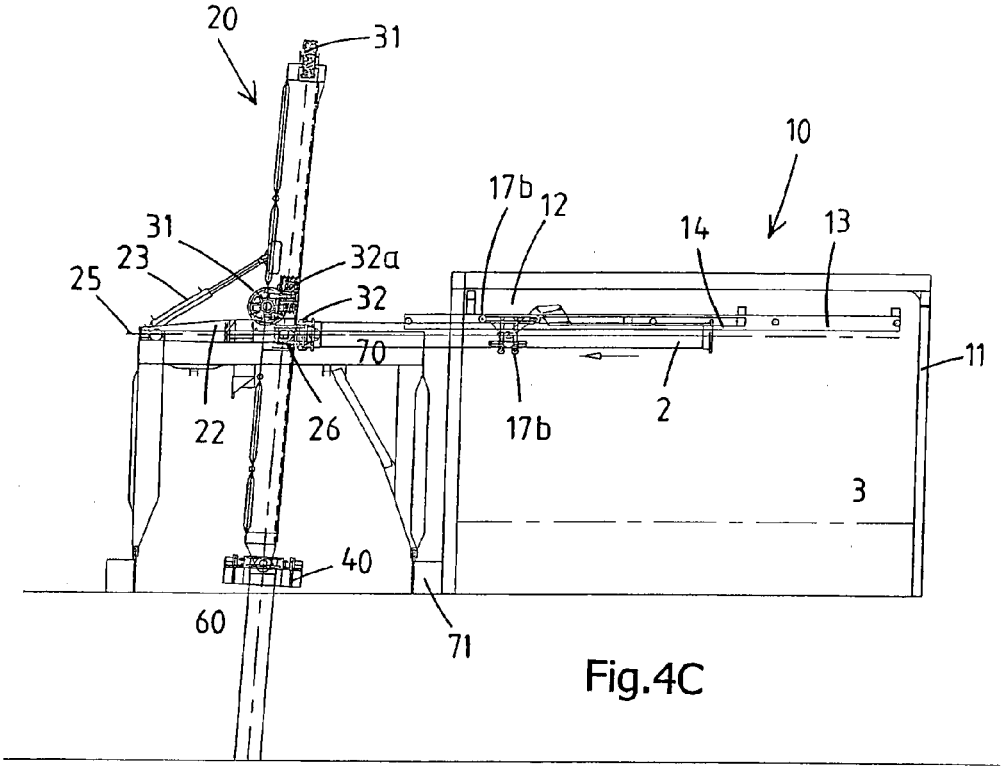

In FIG. 4*c* extension frame 14 is moved in a horizontal direction along loader hoist frame 13, together with gripper 12 and fallpipe section 2. Hence, pipe section 2 is moved horizontally to the tower to shift an end of fallpipe section 2 into engagement with head clamp 32. Head clamp part 32*b* connects to this end of the pipe section 2.

Figure 4D:
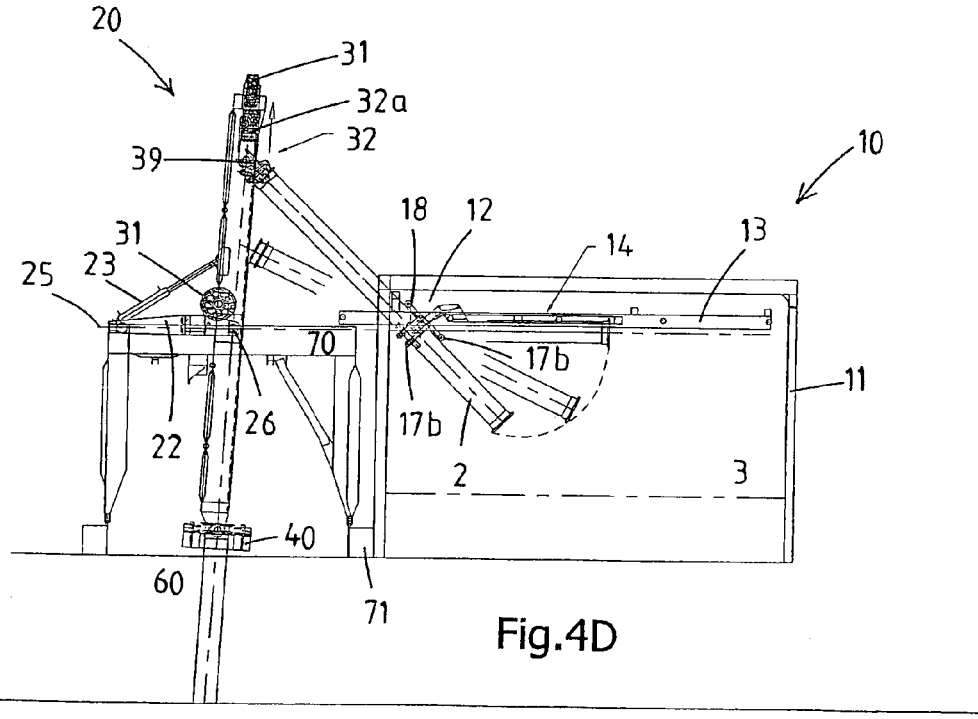

In FIG. 4*d* the head clamp 32 with engaged fallpipe section 2 is raised to in the tower. Head clamp 32 is in a free-pivotal mode, allowing the clamp part 32*b* to rotate as desired while also gripper 12 is allowed to rotate as desired. Gripper 12 allows the fallpipe section 2 to freely translate along rollers 17*b* and the gripper is gimballed itself, thereby decoupling the motion of the tower 20 and the vessel mounted pipe handling means 10. When the head clamp 32 is raised, the pipe sections held thereby gradually takes over the motions of the tower 20 until it is suspended diagonally from the head clamp 32 at its upper end and from the gripper at about half of the length of the fallpipe section 2.

Figure 4E:
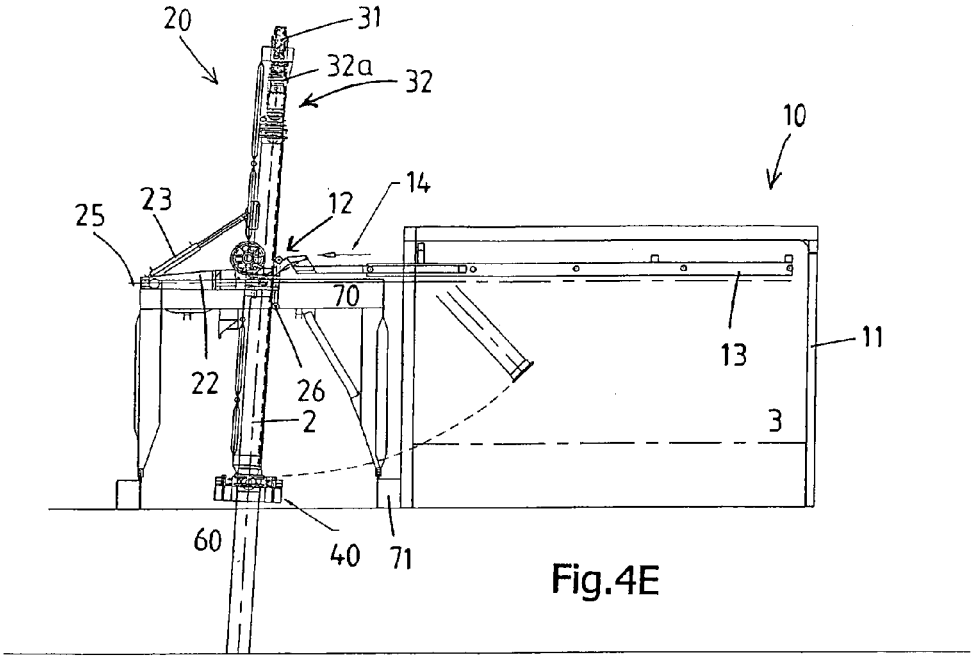

In FIG. 4*e* the gripper 12 is moved towards the tower 20, in particular towards the engagement position, thereby pushing the pipe section 2 into the assembly tower 20 such that the new fallpipe section 2 is aligned with the fallpipe assembly tower 20 in its pivotal mode. New fallpipe section 2 can now be coupled to a suspended fallpipe already suspended in the fallpipe support means 40 at the lower end of the tower 20, which fallpipe support means 40 are arrested now with regard to the tower.

Figure 4F:
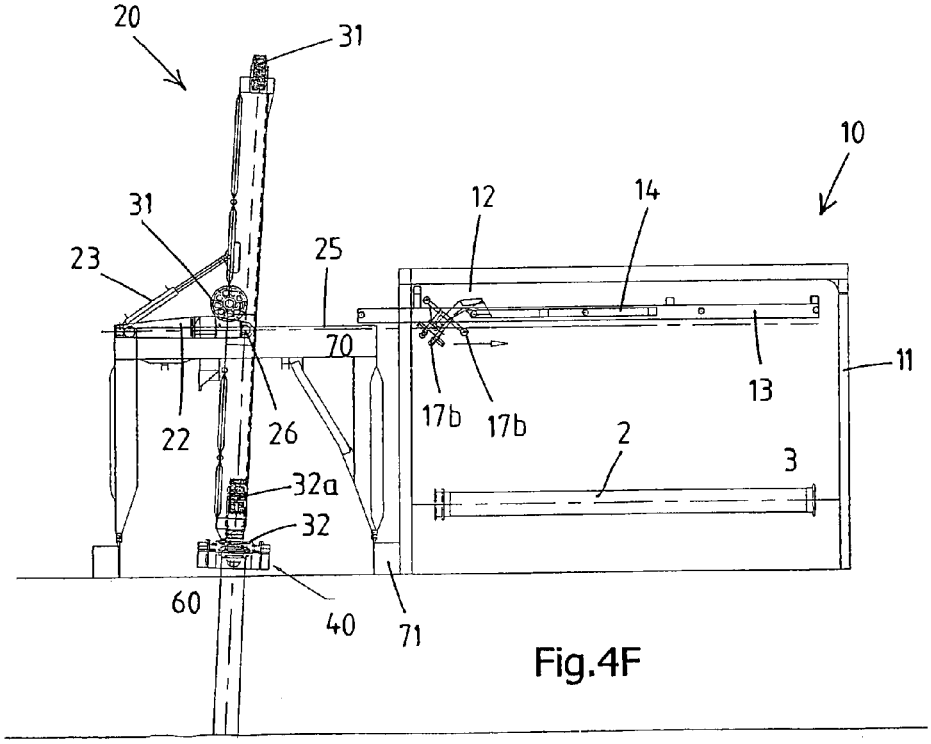

In FIG. 4*f* gripper 12 is disconnected from the fallpipe section 2 and is moved back to the position shown in FIG. 5*b*. After retracting of the gripper 12 and opening the fallpipe support means 40 the head clamp 32 is lowered together with the fallpipe including the just installed new pipe section 2.

In FIGS. 5*a*-5*b* an example of a collet connector 90, 91 is shown, allowing a self-supporting assembly of fallpipe sections 2 and 2'. Any other type of connector may also be suitable. Collet connector 90, 91 comprises a sleeve 90 that can move up and down. Collet 91 has multiple collet members 91*a* placed in a circle between the sleeve 90 and the lower end of the pipe section 2, these members 91*a* being movable to allow radial motion of their lower end. After pipe section 2' is placed on pipe section 2 sleeve 90 is moved downwards along pipe section 2', as a result of which collet 91 will contract and the members 91*a* will grip the under the collar edge part 2*a* of fallpipe section 2, thereby achieving the clamping action.

As explained above the cylinders 23, 24 can be configured for several tasks when desired, such as:

active pivoting of the tower to obtain pivotal motion,
dampen pivoting tower motion,
arrest pivoting tower motion,
tilt tower between operative and inoperative position.

Arresting the tower, e.g. in vertical orientation, can e.g. be done when starting the assembly of a fallpipe, when just the first few fallpipe sections are lowered into the water from the tower.

In FIG. 6*a* a cross section of a vessel 101 according to the third aspect is shown. The shown vessel 101 is a fallpipe vessel, although the invention according to the third aspect is not limited to fall pipe vessels.

The vessel 101 comprises a hull and a pipe section storage for storing the pipe sections (not shown). The hull supports a base frame 102 supporting a tower sub-structure 103 which supports a tower structure 104. Said tower 104 is adapted for assembly of the pipe by addition of a pipe section to the upper end of the suspended pipe 106.

The tower 104 comprises pipe support means 105, in this embodiment a hang-off clamp 105, for supporting the suspended pipe 106. The shown hang-off clamp 105 comprises four individually operable clamping members 105*a*. This is in particular clear from FIGS. 6*a* and 6*b* together, which figures both are cross sections along the longitudinal axis of the tower but are perpendicular with respect to each other.

A tower gimbal structure 122 is provided between the tower sub-structure 103 connected to the hull and the tower 104 providing a pivotal mode for the tower 104. In this embodiment, the tower is pivotable about a pivot axis 123 and a pivot axis 124 with respect to the hull. As such, the tower—and the pipe suspended there from—have in the planes associated with said pivot axes an orientation essentially independent from sea-state induced vessel motions.

The tower 104 further comprises hoist means 130, 131 for lowering the suspended pipe. Pipe section handling means are provided to bring a pipe section in alignment with the uppermost end of the suspended pipe 106 in order to assemble the pipe. The pipe section handling means comprise a travelling block 132 provided with a head clamp 134 adapted for clamping an end of a pipe section. The clamp 134 is translatable up and down with respect to the tower in order to raise and lower the end of the pipe section. In the shown embodiment the clamp 134 suspends from hoist means 131. The head clamp 134 is suitable for supporting the suspended pipeline.

According to the third aspect of the invention, additional pipe engagement means 140, 141 are provided in the tower at a distance from the clamp 134, which additional pipe engagement means 140, 141 can withstand substantially lateral forces exerted by the suspended pipeline 106, such that the suspended pipeline 106 exerts forces on the tower 104 on two distinct areas, creating a moment of force on the tower 104 during assembly and disassembly of the pipe. Both pipe engagement means 140, 141 are embodied as rollerboxes in the present embodiment. A cross section of the pipe engagement means 140 is shown in FIG. 6*c*.

Upper pipe engagement means 140 are provided at a distance above the pipe support means 105. This upper rollerbox 140 is shown in cross section in FIG. 6*c*, from which it is visible that the rollerbox 140 comprises a frame 140*b* and four individually operable rollers 140*a*. In the situation shown in FIG. 6*c*, the pipe is only engaged with two of the four rollers 140*a* of this rollerbox 140.

Lower pipe engagement means 141 are provided at a distance below the pipe support means 105, suspending from a frame 143. The upper and lower pipe engagement means 140, 141 may operate sequentially.

A possible pipe building procedure according to the third aspect of the invention is shown schematically in FIGS. 7*a*-7*j*. As the shown embodiment is essentially similar tot the embodiment of FIG. 6, same parts have been given same numbers.

To perform a pipe building procedure as shown in FIGS. 7*a*-7*j*, the tower is preferably set in a free gimballing mode.

In the shown embodiment, the pipe section handling means comprise a travelling block 132 provided with a head clamp 134. The operation of the pipe section handling means 134 is as follows. Before positioning a pipe in the tower 104, the travelling block 132 is at a gimbal position. The head clamp 134 is rotated 90° and opened to receive a pipe end of a pipe section 108. Pipe section 108 is positioned with an end, here provided with a collar 108*a*, into firingline 109 of the tower 104. Such positioning is performed by the pipe section handling means, e.g. comprising a pipe loader (not shown). Subsequently, the head clamp 134 closes around collar 108*a* and the pipe section 108 is hoisted up to the highest position, suspending from the head clamp 134. This is the position shown in FIG. 7*a*. At the lower end of the pipe section 108 is also a collar 108*b* provided.

Figure 7E:
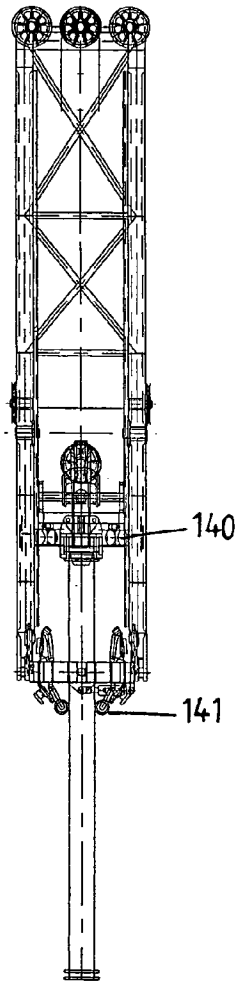
Figure 7D:
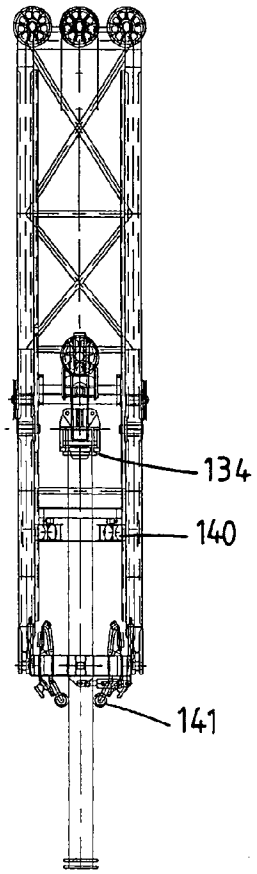
Figure 7C:
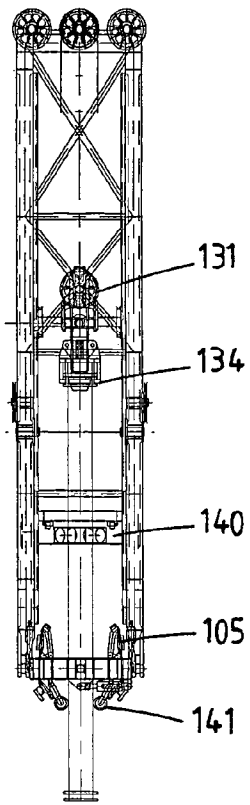
Figure 7B:
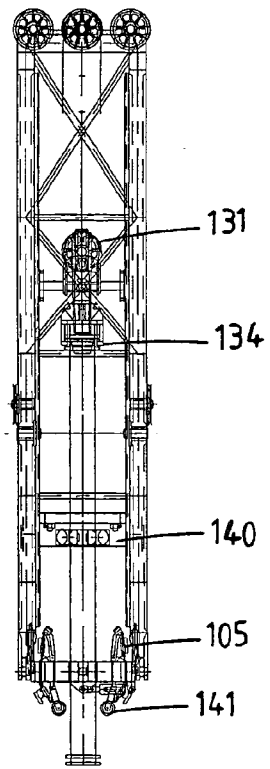
Figure 7A:
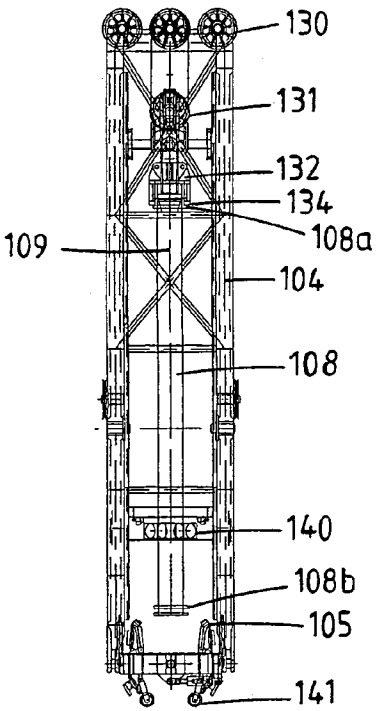

Once the pipe section 108 is suspended in the tower, the upper rollerbox 140 closes, as is also shown in FIG. 7*a*. The hang off module 105 and the lower rollerbox 141 are opened. Now, the suspended pipe section 108 exerts forces on the tower 104 via the upper rollerbox 140 and the head clamp 134.

In FIG. 7*b*, the pipe section 108 is lowered by the travelling block 132 and hoist means 130, 131. The upper rollerbox 140 is closed, while hang off module 105 and lower rollerbox 141 are opened. While lowering the pipe section 108 further, as shown in FIG. 7*c*, the lower rollerbox 141 is being closed when lower collar 108*b* is below the lower rollerbox 141. For example, the lower rollerbox closes when the distance between the travelling block gimbal and the upper rollerbox is less than several meters, e.g. 7 meters. The upper rollerbox 140 remains closed and the hang off module 105 remains opened.

In FIG. 7*d* it is shown that upon further lowering of the pipe section 108, the lower rollerbox 141 is entirely closed. Now, the upper rollerbox 140 is allowed to open. In FIG. 7*e*, when pipe section 108 is lowered further, the lower rollerbox 141 is entirely closed and the upper rollerbox 140 is entirely open. As such, the head clamp 134 and the upper collar 108*a* may pass the upper rollerbox 140. The hang off module 105 remains opened. As such, the suspended pipe section 108 now exerts forces on the tower 104 via the lower rollerbox 141 and the head clamp 134.

Figure 7J:
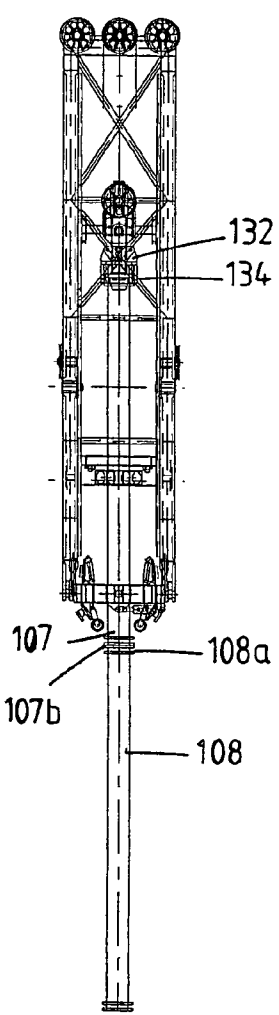
Figure 7I:
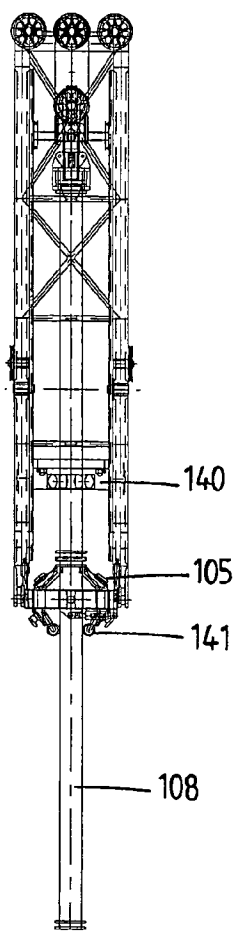
Figure 7H:
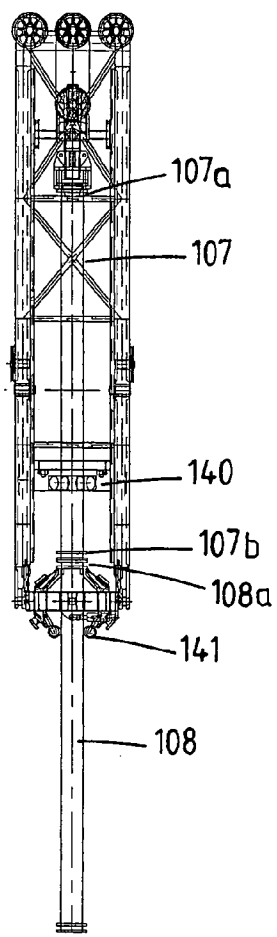
Figure 7G:
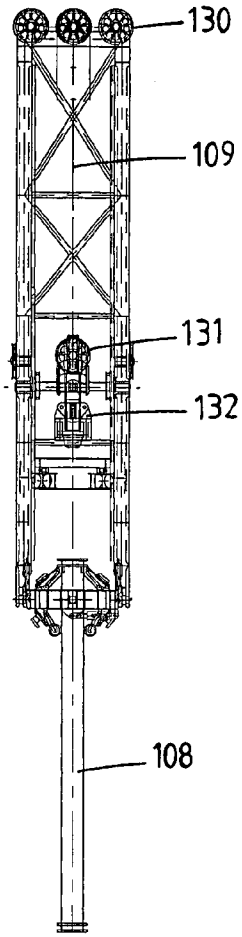
Figure 7F:
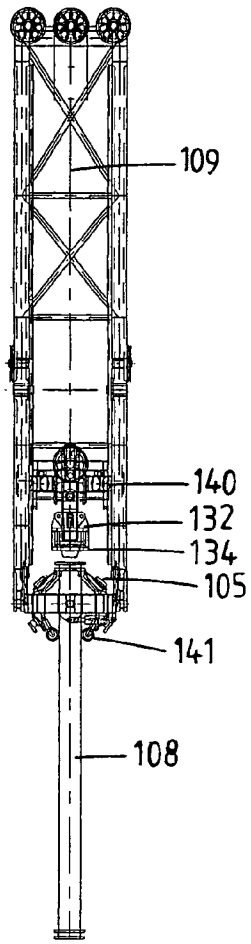

In FIG. 7*f*, the pipe support means, embodied as hang off module 105 are closed to support the suspended pipe section 108. The travelling block 132 is at is lowest position. Closing the hang off module 105 allows the load to be transferred from the head clamp 134 to the hang off module 105, and thus the head clamp 134 is allowed to open and to be raised again, as shown in FIG. 7*f* and further in FIGS. 7*g* and 7*h*. The lower rollerbox 141 remains closed and the upper rollerbox 140 opened. Now, the suspended pipe section 108 exerts forces on the tower 104 via the lower rollerbox 141 and the hang off module 105.

In FIG. 7*g*, the hoisting up of the travelling block 132 by hoist means 130, 131 is shown. The travelling block 132 is hoisted up until the position shown in FIG. 7, in which again the head clamp 134 is allowed to rotate 90° and a new pipe section 107 is positioned with its upper collar 107*a* in the firing line 109 of tower 104. The head clamp 134 closes around upper collar 107*a*.

During this procedure, the upper rollerbox 140 remains opened and the hang off module 105 remains closed. Also lower rollerbox 141 may remain closed, especially for low pipe tensions to allow the pipe collar 108*a* to stay in the hang off module 105. In this situation, the suspended pipe section 108 exerts forces on the tower 104 via the lower rollerbox 141 and the hang off module 105. It is also conceivable to allow the lower rollerbox 141 to open, in which case the suspended pipe section 108 exerts forces on the tower 104 via only via hang off module 105.

In FIG. 7*h*, upper rollerbox 140 closes around pipe section 107, similar to the situation shown in FIG. 7*a*. The travelling block 132 is lowered until a lower collar 107*b* at the lower end of the pipe section 107 is on top of the upper collar 108*a* of pipe section 108. The hang off module 105 supports upper collar 108*a* of pipe section 108.

In the situation shown in FIG. 7*i* the pipes 107 and 108 are mutually connected via lower collar 107*b* and upper collar 108*a*. The upper rollerbox 140 and the lower rollerbox 141 are still closed.

Once the pipe sections 107 and 108 are connected, the head clamp 132 is hoisted up for a small distance to clear the suspended pipe from the hang off module 105 and the hang off module 105 is allowed to open. Also the lower rollerbox is allowed to open, as is shown in FIG. 7*j*. This situation is comparable to the situation shown in FIG. 7*b*, with the difference that in FIG. 7*j* two pipe sections 107 and 108 are suspending from the head clamp 134.

In FIG. 8 a cross section of a portion of an alternative fallpipe stone dumping vessel 201 is shown. The vessel comprises a hull 201*a* and a fallpipe section storage 202 for storing fall pipe sections 203.

A tower 220 is provided which is adapted for assembly and disassembly of the fallpipe by addition of a fallpipe section to the upper end of the suspended fallpipe or removal of a fallpipe section from the suspended fallpipe, respectively. The tower comprises fallpipe support means 240, here embodied as a hang off module, for supporting the suspended fallpipe. Similar to the towers shown in FIGS. 6 and 7, this tower 220 is also provided with upper pipe engagement means 241 and lower pipe engagement means 242. Hoist means 230 are provided for lowering and raising the suspended fallpipe.

A tower gimbal structure is provided between a frame 223 mounted on the hull 201*a* and the tower 220 providing a pivotal mode for the tower. The vessel is further provided with tilting means which are adapted to tilt the tower 220 from the substantially vertical position in which the fallpipe is assembled and disassembled to a tilted position as is shown in FIG. 8.

The vessel of FIG. 8 comprises a telescopable pipe section 260. Telescopable pipe sections are used to compensate for height differences of the bottom of the sea. The shown embodiment is suitable to install a telescopable pipe section 260 between an ROV 250, positioned at the seabed, and the suspended fallpipe. In this preferred embodiment, the telescopable pipe section 260 can be handled together with an ROV 250 when the tower 220 is tilted.

In FIG. 8, ROV 250 is positioned in the area below the tilted tower 220, on a moonpool hatch 255 above moonpool 256. The ROV 250 of this embodiment was originally stored below the tower 220. The telescopable pipe section 260 of this embodiment was originally stored in the tower 220. After assembly of the telescopable pipe section 260 to the ROV 250 the tower is allowed to tilt. The ROV 250 is raised, together with the telescopable pipe section 260, in the shown embodiment by winches 225 and cables 226, i.e. the umbilicals of the ROV 250 itself. Before subsequent assembly of the fallpipe, the ROV 250 is lowered together with the telescopable pipe section 260.

An alternative example of a telescopable pipe section 280 is shown in FIGS. 9*a* and 9*b*. Telescopable pipe section 280 comprises an upper part 281 and a lower part 282. The diameter of the upper part 281 is smaller than the diameter of the lower part 282, allowing telescoping of the upper part 281 into and out of the lower part 282. The upper part 281 here comprises an upper collar 281*a* and a lower end 281*b* without a collar. Lower part 282 is provided around the upper part 281 and comprises an upper collar 282*a*, adapted for the connection of cables, and a lower collar 282*b*, which may be connected to another pipe section.

The upper part 281 is provided with mounting means 281*c* to be able to be supported by the fallpipe support means 290, shown in FIG. 9*b*. The fall pipe support means 290 are here embodied as a hang off module. Further pipe engagement means 292 are also provided here, according to the third aspect of the invention. In this embodiment, the fallpipe support means 290 also support the upper part of the telescopable pipe section 281, but alternatively the fallpipe support means 290 may comprise distinct upper part support means for supporting the upper part of the telescopable pipe section.

In the shown embodiment, two cables 295 are connected to the lower part 282 of the telescopable pipe section, which allows lowering and raising of the lower part 282 along the upper part 281.

The fallpipe section handling means according to the invention comprise a clamp 285 which is translatable up and down with respect to the tower (not shown), the clamp 285 comprising cable support means 286 for the cable 295 supporting the lower part 282 of the telescopable pipe section. The lower part of the telescopable pipe section supports the suspended fallpipe, such that the length of the telescopable pipe section and thus of the suspended fallpipe is adjustable by lowering and raising the clamp 285.

The operation is visible in FIG. 9*b*. The lower pipe section 282 supports a suspended fallpipe 283 via lower collar 282*b*. The lower pipe section 282 is supported by cables 295 from clamp 285. The upper pipe section 281 is supported by hang off module 280. In the left part of FIG. 9*b* the clamp 285 is lowered and thus the lower pipe section 282 has been slid downwards along the upper pipe section 281, lengthening the fallpipe suspending from the vessel. In the right-hand part of FIG. 9*b* the clamp 285 has been raised, and thus the lower pipe section 282 as been moved upwards, now surrounding the upper pipe section 281. As such, the length of the fallpipe suspending from the vessel is decreased. The variation in length achievable with such telescopable pipe section may vary between 3 and 15 meters, preferably between 5 and 8 meters.

In FIGS. 10 and 11 a portion of a tower 300 is shown, and a portion of a tower gimbal structure 322 which is provided between the hull and the tower providing a pivotal mode of the tower 300 wherein the tower is pivotable about a pivot axis 323 with respect to the hull so that the tower 300 and a fallpipe suspended there from has in a plane associated with said at least one pivot axis 323 an orientation essentially independent from sea-state induced vessel motions.

A hydraulic cylinder 330 is provided between the tower 330 and a structure 340 connected to the hull, which cylinder 330 is adapted to perform at least one of the following tasks: active pivoting of the tower to obtain pivotal motion; dampen pivoting tower motion; arrest pivoting tower motion; tilt the tower between an operative and an inoperative position.

According to a preferred embodiment, a rod linkage mechanism 350 is provided between the tower 300 and the hydraulic cylinder 330, which rod linkage mechanism 350 is releasable from a fixed position shown in FIG. 10 to a freely pivotable position shown in FIG. 11.

In the fixed position shown in FIG. 10, rod 351 is fixed as the ends 353 and 352 are fixed. Thus, the hydraulic cylinder 330 is pivotable about pivot axes 331 and 354, and the hydraulic cylinder 330 is adapted to perform at least one of the following tasks: active pivoting of the tower to obtain pivotal motion; dampen pivoting tower motion; arrest pivoting tower motion; tilt the tower between an operative and an inoperative position.

In the freely pivotable position shown in FIG. 11 the end 352 of the rod 351 is no longer fixed to the tower at fixing point 355. In this freely pivotable position the rod linkage mechanism allows essentially undampened pivoting tower motion, as pivoting of the tower 300 is allowed by freely pivoting the rod 351 and the cylinder 330 about pivot axes 353, 354 and 331.

In FIGS. 12-14 a pipe gripping assembly 400 according to the fifth aspect of the invention is shown.

In FIGS. 12*a* and 12*b*, pipe gripping assembly 400 is shown in a position in which it grips a pipe 401, while in FIGS. 13*a*, 13*b*, 14*a* and 14*b* the pipe is not shown.

Pipe gripping assembly 400 comprises four gripping members 410. Each gripping member 410 comprises a pipe engaging portion 411 which is engageable with a portion of the outer circumference of a pipe 401. According to the invention, these gripping members are pivotable about a pivot axis 412 perpendicular to the longitudinal axis 402 of the pipe.

Actuation means (not shown) are provided to rotate the gripping members 410 such that the gripping member 410 is movable between an open position for receiving a pipe, shown in FIGS. 12*b*, 13*a* and 14*b*, and a closed position in which the pipe engaging portion 411 engages with the pipe 401, shown in FIGS. 12*a*, 13*b* and 14*a*. Such actuation means preferably comprise hydraulics.

The shown embodiment of the pipe gripping assembly 400 comprises a connection frame 405 to connect the pipe gripping assembly to pipe handling means, e.g. pipe handling means according to the first, second, third or fourth aspect of the invention.

A base portion 420 is connected to this connection frame 405, which connection may be pivotable about pivot axis 421 as shown or may alternatively be a fixed connection. The connection frame 405 functions as a gripper gimbal, of which the pivot axis 421 in the shown embodiment is perpendicular to the longitudinal axis of the pipe 402, and also perpendicular to the pivot axes 412 of the one or more gripping members. By gimballing the gripper gimbal 405, the pipe is moved from a horizontal to a vertical orientation, or vice versa.

A pipe may be brought in contact with said base portion 420 in an open position of the pipe gripping assembly, before closing the assembly 400 to the closed position in which the pipe engaging portion 411 engages with the pipe 401. In this embodiment, the base portion 420 also comprises a pipe engaging portion 422. In the shown embodiment, the pipe engaging portions 411, 422 comprise rollers, allowing the (fall)pipe section 401 to slide along the pipe gripper assembly 400.

In FIG. 12*b*, it is shown that a portion of pipe 401 engages with pipe engagement portion 422 of the base portion 420, while the pipe gripping members are still in the open position.

The invention claimed is:

1. Fallpipe stone dumping vessel for stone dumping through a fallpipe suspended from the vessel, comprising:

a hull, a fallpipe section storage for storing fallpipe sections, a tower at least comprising a fallpipe support mechanism configured to support the suspended fallpipe, said tower being adapted for assembly and disassembly of the fallpipe by addition of a fallpipe section to the upper end of the suspended fallpipe or removal of a fallpipe section from the suspended fallpipe, respectively, a tower gimbal structure provided between the hull and the tower providing a pivotal mode for the tower wherein the tower is pivotable about at least one pivot axis with respect to the hull so that the tower—and the fallpipe suspended there from—has in a plane associated with said at least one pivot axis an orientation essentially independent from sea-state induced vessel motions, a hoist mechanism configured to raise and lower the suspended fallpipe, a fallpipe section handling mechanism, adapted to—while the tower is in its pivotal mode—advance a fall pipe section to the tower and to bring said fallpipe section in alignment with the uppermost end of the suspended fallpipe in order to assemble the fallpipe and adapted to—while the tower is in its pivotal mode—disconnect a fallpipe section from the uppermost end of the suspended fallpipe and advance it to the storage in order to disassemble the fallpipe, wherein the fallpipe section handling mechanism includes a head clamp adapted to clamp an end of fallpipe section, which head clamp is translatable up and down with respect to the tower in order to raise and lower the end of the fallpipe section, wherein the fallpipe section handling mechanism is adapted to present the end of a fallpipe section—which has been retrieved from the storage and is to be advanced to the tower—to the head clamp whilst the head clamp is held at an engagement position thereof, said engagement position being located on or in the vicinity of the at least one pivot axis of the tower gimbal structure, and wherein the head clamp has a main head clamp body adapted to be translated up and down along the tower and an articulated engagement head clamp part adapted to be brought into engagement with the end of the fallpipe section, wherein orientation mechanism is provided to bring the engagement part in alignment with the end of the fallpipe section presented to the head clamp whilst in its engagement position.

2. Vessel according to claim 1, wherein the tower gimbal structure is a two-axis gimbal structure having two perpendicular and intersecting pivot axes.

3. Vessel according to claim 1, wherein the head clamp is connected to the hoist means, so that the suspended fallpipe is also raised and lowered with said head clamp.

4. Vessel according to claim 1, wherein the engagement position is located on or in the vicinity of a point of intersection of the two intersecting pivot axes of the tower gimbal structure.

5. Vessel according to claim 1, wherein the fallpipe section handling mechanism is adapted to retain and guide the fallpipe section at a position remote from the end engaged by the head clamp as the head clamp is translated upward and said upper end of the fallpipe section is raised, the fall pipe section handling mechanism guiding the lower portion of the fallpipe section until the fallpipe is aligned with the upper end of the suspended fallpipe.

6. Vessel according to claim 1, wherein the fallpipe section handling mechanism include a gripper adapted to grip a fall pipe section at a location remote from the end to be engaged with the head clamp.

7. Vessel according to claim 6, wherein the gripper is adapted to allow for linear displacement of the fallpipe section with respect to the gripper.

8. Vessel according to claim 1, wherein the fallpipe section handling mechanism is adapted to bring the gripper to the engagement position in order to align the fall pipe section with the suspended fallpipe.

9. Vessel according to claim 1, wherein the tower gimbal structure includes a pivot mechanism defining a stationary horizontal pivot axis.

10. Vessel according to claim 9, wherein the fallpipe section handling mechanism is adapted to bring a fallpipe section to be advanced to the tower in a position coaxial with said horizontal pivot axis, and then shift the fallpipe section towards the tower so as to engage an end of the fallpipe section with the head clamp.

11. Vessel according to claim 10, wherein the fallpipe section handling mechanism includes a frame with a horizontal guide structure, the gripper being mounted on a gripper base slidable along said guide structure, the gripper being articulated with respect to the base in order to adapt the gripper position to the orientation of the fallpipe section.

12. Vessel according to claim 1, wherein a further gimbal structure is provided between the tower and the fallpipe support mechanism of the tower.

13. Vessel according to claim 12, wherein an arresting mechanism is provided and configured to allow arresting of the pivotal motion of the tower, and wherein the further gimbal structure allows pivotal motion of the arrested tower with respect to the suspended fallpipe.

14. Vessel according to claim 12, wherein an arresting mechanism is provided and configured to allow arresting of the pivotal motion of the fallpipe support mechanism with respect to the tower.

15. Vessel according to claim 1, wherein a tilting mechanism is provided and configured to tilt the tower between a substantially vertical operational position to a more horizontal and inoperative position, for the purpose of ROV handling in an area below the tower in its inoperative position.

16. Vessel according to claim 15, further comprising a telescopable pipe section.

17. Vessel according to claim 16, wherein the telescopable pipe section is handled together with an ROV when the tower is tilted.

18. Vessel according to claim 16, wherein the fallpipe support mechanism includes an upper part support mechanism configured to support the upper part of the telescopable pipe section, and the fallpipe section handling mechanism includes a clamp which is translatable up and down with respect to the tower, the clamp comprising a cable support mechanism configured to provide a cable supporting the lower part of the telescopable pipe section, wherein the lower part of the telescopable pipe section supports the suspended fallpipe, such that the length of the telescopable pipe section and thus of the suspended fallpipe is adjustable by lowering and raising the clamp.

19. Vessel according to claim 1, wherein one or more hydraulic cylinders are provided which engage on the tower, said hydraulic cylinders being adapted to perform at least one of the following tasks:

active pivoting of the tower to obtain pivotal motion, dampen pivoting tower motion, arrest pivoting tower motion, tilt tower between operative and inoperative position.

20. Vessel according to claim 1, wherein the fallpipe handling mechanism is adapted to bring the fall pipe section to be advanced to the tower—during its advance to the tower—into an orientation aligned with the tower, said fallpipe handling mechanism being provided with an automatic synchronising system which—during the advance of the fallpipe section to tower—causes a synchronised pivotal motion of the fallpipe section which is synchronised with the tower in its pivotal mode—at the latest as the fallpipe section reaches the tower—.

21. Vessel according to claim 1, wherein the fallpipe sections have integral mechanical connectors to connect one end of a fallpipe section to an adjacent fallpipe section so that a self-supporting fallpipe is obtained.

22. Vessel according to claim 21, wherein said the mechanical connector is a collet connector.

23. Vessel according to claim 21, wherein the mechanical connector is a bayonet connector.

24. Vessel according to claim 1, wherein the fallpipe sections have integral mechanical connectors to connect one end of a fallpipe section to an adjacent fallpipe section so that a self-supporting fallpipe is obtained, and wherein the head clamp comprises a rotation device to rotate a fallpipe section clamped by the head clamp about its longitudinal axis, allowing the fallpipe section clamped by the head clamp to be connected to an adjacent fallpipe section of the suspended fallpipe by rotation of the fallpipe section.

25. Method for stone dumping, using a fallpipe vessel according to claim 1.

26. Vessel with a system for assembly of a pipe to be lowered into the water and suspended from the vessel, the vessel comprising:

a hull, a pipe section storage for storing pipe sections, a tower at least comprising a pipe support mechanism configured to support the suspended pipe, said tower being adapted for assembly of the pipe by addition of a pipe section to the upper end of the suspended pipe, a gimbal structure provided between the hull and the tower providing a pivotal mode for the tower wherein the tower is pivotable about at least one pivot axis with respect to the hull, the tower having a free-pivotal mode where the pivotal motion is caused by forces exerted on the tower by the suspended fallpipe, in which free-pivotal mode the tower is freely pivotable about said at least one pivot axis with respect to the hull so that the tower—and the pipe suspended there from—has in a plane defined by said at least one pivot axis an orientation essentially independent from sea-state induced vessel motions, a hoist mechanism configured to lower the suspended pipe, a pipe section handling mechanism, adapted to—while the tower is in its pivotal mode—advance a pipe section to the tower and to bring said pipe section in alignment with the uppermost end of the suspended pipe in order to assemble the pipe, wherein the pipe section handling mechanism includes a head clamp adapted for clamping an end of pipe section, which head clamp is translatable up and down with respect to the tower in order to raise and lower the end of the pipe section, wherein the pipe section handling mechanism is adapted to present the end of a pipe section—which has been retrieved from the storage and is to be advanced to the tower—to the head clamp whilst the head clamp is held at an engagement position thereof, said engagement position being located on or in the vicinity of the at least one pivot axis formed by the gimbal structure, wherein the head clamp has a main head clamp body adapted to be translated up and down along the tower and an articulated engagement head clamp part adapted to be brought into engagement with the end of the pipe section, and wherein an orientation mechanism is provided to bring the engagement part in alignment with the end of the pipe section presented by the head clamp whilst in its engagement position.

27. Vessel according to claim 26, wherein the pipe section handling mechanism is adapted to retain and guide the pipe section at a position remote from the end engaged by the head clamp as the head clamp is translated upward and said upper end of the pipe section is raised, the pipe section handling mechanism guiding the lower portion of the pipe section until the pipe section is aligned with the upper end of the suspended pipe.

28. Vessel with a system for assembly of a pipe to be lowered into the water and suspended from the vessel, the vessel comprising:

a hull, a pipe section storage for storing the pipe sections, a tower comprising a pipe support mechanism to support the suspended pipe, said tower being adapted for assembly of the pipe by addition of a pipe section to the upper end of the suspended pipe, a tower gimbal structure provided between the hull and the tower providing a pivotal mode for the tower wherein the tower is pivotable about at least one pivot axis with respect to the hull so that the tower—and the pipe suspended there from—has in a plane associated with said at least one pivot axis an orientation essentially independent from sea-state induced vessel motions, a hoist mechanism to lower the suspended pipe, a pipe section handling mechanism, adapted to—while the tower is in its pivotal mode—advance a pipe section to the tower and to bring said pipe section in alignment with the uppermost end of the suspended pipe in order to assemble the pipe, the pipe section handling mechanism includes a clamp adapted for clamping an end of a pipe section, which clamp is translatable up and down with respect to the tower in order to raise and lower the end of the pipe section, wherein an additional pipe engagement mechanism is provided in the tower at a distance from the clamp, which the additional pipe engagement mechanism withstands substantially lateral forces exerted by the suspended pipeline, such that the suspended pipeline exerts forces on the tower on two distinct areas, creating a moment of force on the tower during assembly and disassembly of the pipe, and wherein the pipe engagement mechanism includes one or more rollerboxes.

29. Vessel according to claim 28, wherein the pipe engagement mechanism includes an upper pipe engagement mechanism and a lower pipe engagement mechanism, which operate sequentially.

30. Vessel according to claim 28, wherein the vessel is a fallpipe stone dumping vessel for stone dumping through a fallpipe suspended from the vessel.

31. Fallpipe stone dumping vessel for stone dumping through a fallpipe suspended from the vessel, comprising:

a hull, a fallpipe section storage for storing fallpipe sections, a tower at least comprising a fallpipe support mechanism to support the suspended fallpipe, said tower being adapted for assembly and disassembly of the fallpipe by addition of a fallpipe section to the upper end of the suspended fallpipe or removal of a fallpipe section from the suspended fallpipe, respectively, a tower gimbal structure provided between the hull and the tower including a pivot mechanism defining at least one stationary pivot axis, the tower gimbal structure providing a pivotal mode for the tower wherein the tower is pivotable about the at least one pivot axis with respect to the hull so that the tower—and the fallpipe suspended there from—has in a plane associated with said at least one pivot axis an orientation essentially independent from sea-state induced vessel motions, a hoist mechanism configured to lower and raise the suspended fallpipe, and a fallpipe section handling mechanism, adapted to—while the tower is in its pivotal mode—advance a fall pipe section to the tower and to bring said fallpipe section in a position coaxial with said at least one pivot axis, to bring the fallpipe section in alignment with the uppermost end of the suspended tailpipe and then shift the fallpipe section towards the tower so as to engage an end of the fallpipe section with the fallpipe section handling mechanism, in order to assemble the fallpipe and wherein the fallpipe section handling mechanism is adapted to—while the tower is in its pivotal mode—disconnect a fallpipe section from the uppermost end of the suspended fallpipe and advance it to the storage in order to disassemble the fallpipe.

32. Fallpipe stone dumping vessel for stone dumping through a fallpipe suspended from the vessel, comprising:

a hull, a fallpipe section storage for storing fallpipe sections, a tower at least comprising a fallpipe support mechanism configured to support the suspended fallpipe, said tower being adapted for assembly and disassembly of the fallpipe by addition of a fallpipe section to the upper end of the suspended fallpipe or removal of a fallpipe section from the suspended fallpipe, respectively, a tower gimbal structure provided between the hull and the tower providing a pivotal mode for the tower wherein the tower is pivotable about at least one pivot axis with respect to the hull so that the tower—and the fallpipe suspended there from—has in a plane associated with said at least one pivot axis an orientation essentially independent from sea-state induced vessel motions, a hoist mechanism configured to lower and raise the suspended fallpipe, a fallpipe section handling mechanism, adapted to—while the tower is in its pivotal mode—advance a fall pipe section to the tower and to bring said fallpipe section in alignment with the uppermost end of the suspended fallpipe in order to assemble the fallpipe and adapted to—while the tower is in its pivotal mode—disconnect a fallpipe section from the uppermost end of the suspended fallpipe and advance it to the storage in order to disassemble the fallpipe, wherein one or more hydraulic cylinders are provided which engage on the tower, said hydraulic cylinders being adapted to perform at least one of the following tasks:

active pivoting of the tower to obtain pivotal motion, dampen pivoting tower motion, arrest pivoting tower motion, and tilt tower between operative and inoperative position, and further comprising one or more rod linkage mechanisms provided between the tower and the one or more hydraulic cylinders, which rod linkage mechanism is releasable from a fixed position to a freely pivotable position, in which fixed position the hydraulic cylinders are adapted to perform at least one of the above-indicated tasks, and in which freely pivotable position the rod linkage mechanism allows essentially undampened pivoting tower motion.

* * * * *